US008911334B1

(12) United States Patent
Cotter et al.

(10) Patent No.: US 8,911,334 B1
(45) Date of Patent: Dec. 16, 2014

(54) EXERCISE DEVICE AND USE THEREOF

(75) Inventors: James E. Cotter, Ashland, OH (US); John Dewey Holt, IV, Collinsville, OK (US)

(73) Assignee: Kamagon Fitness, LLC, Bixby, OK (US)

( * ) Notice: Subject to any disclaimer, the term of this patent is extended or adjusted under 35 U.S.C. 154(b) by 793 days.

(21) Appl. No.: 13/180,896

(22) Filed: Jul. 12, 2011

Related U.S. Application Data

(63) Continuation-in-part of application No. 12/250,222, filed on Oct. 13, 2008, now abandoned.

(51) Int. Cl.

| | |
|---|---|
| ***A63B 21/008*** | (2006.01) |
| ***A63B 21/06*** | (2006.01) |
| ***A63B 21/065*** | (2006.01) |
| ***A63B 37/10*** | (2006.01) |
| ***A63B 39/00*** | (2006.01) |
| ***A63B 41/00*** | (2006.01) |
| ***A63B 43/04*** | (2006.01) |

(52) U.S. Cl.
USPC ..... 482/111; 482/93; 482/105; 437/594

(58) Field of Classification Search
CPC ..... A63B 41/00; A63B 41/02; A63B 41/04; A63B 41/08; A63B 41/085; A63B 41/10
USPC ..... 482/51, 77–78, 85, 91–93, 97, 105, 482/109–111, 148; 441/28–29; 473/576, 473/594, 596–597
See application file for complete search history.

(56) References Cited

U.S. PATENT DOCUMENTS

| | | | | |
|---|---|---|---|---|
| 3,334,899 | A * | 8/1967 | Bosko et al. | 482/108 |
| 4,357,009 | A | 11/1982 | Baker | |
| 4,842,563 | A | 6/1989 | Russell | |
| 4,915,669 | A | 4/1990 | Russell | |
| 4,917,381 | A | 4/1990 | Spector | |
| 5,050,870 | A | 9/1991 | Pollock | |
| 5,236,411 | A * | 8/1993 | Backman | 602/13 |
| 5,282,777 | A * | 2/1994 | Myers | 482/122 |

(Continued)

OTHER PUBLICATIONS

Enamait, Ross, The Water Ball, www.rosstraining.com/articles/thewaterball.html, 2006.

(Continued)

*Primary Examiner* — Oren Ginsberg
(74) *Attorney, Agent, or Firm* — Head, Johnson & Kachigian, P.C.

(57) ABSTRACT

An exercise device having a water-tight, interior compartment into which a destabilizing liquid can be added to fill the device to a desired weight, such as by indicated on weight marks provided on an exterior surface of the exercise device. The device is capable of being filled with the destabilizing liquid via a water port of the device, which may be releasably securable to a water hose or faucet. The destabilizing liquid filling the interior compartment of the exercise device provides resistance to muscular movement and provides destabilization of the device as an aid in improving a user's balance and coordination. Handles and/or at least one protruding knob are provided on the exterior surface of the exercise device, and/or padded straps are provided on the exterior surface of the exercise device for attaching the device to the user's limbs or back. One side of the device may be flattened and padded to increase comfort for the user when the device is attached to the user's body.

30 Claims, 6 Drawing Sheets

(56) References Cited

U.S. PATENT DOCUMENTS

| | | | | |
|---|---|---|---|---|
| 5,735,776 | A | 4/1998 | Swezey et al. | |
| 5,810,700 | A * | 9/1998 | Orcutt | 482/123 |
| 5,857,946 | A | 1/1999 | Brown | |
| 5,967,952 | A | 10/1999 | Bronstein et al. | |
| 6,068,580 | A | 5/2000 | Myers et al. | |
| 6,149,555 | A | 11/2000 | Kinback | |
| D455,182 | S * | 4/2002 | Chu | D21/398 |
| 6,537,125 | B1 | 3/2003 | Motosko | |
| 6,758,795 | B2 | 7/2004 | Barber | |
| D494,233 | S * | 8/2004 | Kerry | D21/662 |
| D498,799 | S | 11/2004 | Kerry | |
| 6,964,635 | B2 * | 11/2005 | Wang | 482/109 |
| D521,084 | S * | 5/2006 | Huang | D21/662 |
| 7,141,012 | B2 | 11/2006 | Lin | |
| 8,096,924 | B2 * | 1/2012 | Mittelsteadt | 482/44 |
| 2005/0107229 | A1 * | 5/2005 | Wickens | 482/140 |

OTHER PUBLICATIONS

Shanghai Nancy Sporting Goods Co., Weight Ball/Medicine Ball, Sep. 26, 2008, http://.nancysports.com.

* cited by examiner

EXERCISE DEVICE AND USE THEREOF

CROSS-REFERENCE TO RELATED APPLICATIONS

This application claims priority to and is a continuation-in-part of U.S. patent application Ser. No. 12/250,222, filed Oct. 13, 2008, which is incorporated herein by reference.

BACKGROUND OF THE INVENTION

1. Field of the Invention

This invention relates generally to an exercise device and use thereof, and more particularly to an exercise device constructed with handles and/or at least one protruding knob, and/or which can be secured to the user's limbs by a padded strap and/or held on a user's back via shoulder straps that attach to the exercise device. The exercise device is constructed with a single, open interior compartment capable of being filled with a destabilizing liquid, which serves the dual purpose of providing resistance to muscular movement and providing destabilization of the exercise as an aid in improving the user's balance and coordination by working the user's stabilizing muscles.

2. Description of the Related Art

Exercise devices with handles for ease of holding the device are available. During a weight bearing exercise with standard handles, the smaller muscle groups of the flexor carpi radialis, flexor carpi ulnaris and/or brachioradialis muscles of the forearms and hands act merely as extensions of the major muscle groups in the arms and torso, with minimal recruitment of the aforementioned muscles of the forearms and hands.

Further, exercise devices are known that can be filled with water or other material as a means of adding an amount of weight to the device. Some of these devices are designed to receive particulate material such as sand or liquids such as water. Sand adds the desired resistance weight, but does not move around freely like fluids do, thereby stabilizing the exercise device. Those devices that employ water generally do so because the water can be drained from the device to reduce the weight of the device and allow the device to collapse to a reduced volume for storage and transport. Further when water is used, many of the devices employ internal baffles to inhibit rapid motion of substantial amounts of fluid in response to motion of the exercise device or add chemicals that react with the water to form a gel that does not move around freely within the device. Use of internal baffles or chemicals that form a gel within the devices are employed to increase the stability of the exercise device, and eliminate the benefits derived from the purposeful exploitation of the inertia generated by an unstable fluid.

Still other devices are known that are simply a ball filled with water that has no baffles, but also has no handles or other means of holding the ball or attaching the ball to the user's body. These water filled balls are hard to handle and can only be used by holding them with the arms. Because the arms of the user are occupied by holding this type of water filled ball, the user can not engage in training activities for many sports, such as for example tennis, baseball, wrestling, biking, etc. while using these types of devices.

Some other devices provide positional instability for the user by utilizing a shape that sits unevenly on the floor and is meant to be stood, lain or sat upon. Some of those devices introduce filler into the device as ballast in order to reduce the amount of movement when the user is sitting, standing or laying on it in order to make the device easier for an inexperienced user. These exercise devices utilize the concept of positional instability (i.e., sitting, standing or laying on the device) in order to strengthen the core supportive muscles and increase balance and proprioceptive awareness. The practical disadvantage of this design is that other devices, such as traditional weights or weighted cables, must be utilized with the device in order to introduce muscular resistance into one's exercise routine. Further, the number of exercises and movements which can be performed while sitting, standing or laying on the device are limited, and the user cannot utilize a full range of motion while positioned on the device.

It is therefore desirable to provide an exercise device and use thereof that utilizes handles and/or at least one protruding knob, and/or which can be secured to the user's limbs by a padded strap and/or held on a user's back via shoulder straps that attach to the exercise device.

It is further desirable to provide an exercise device constructed with a single, open interior compartment capable of being filled with a destabilizing liquid, which serves the dual purpose of providing resistance to muscular movement and providing destabilization of the exercise as an aid in improving the user's balance and coordination by working the user's stabilizing muscles.

It is still further desirable to provide an exercise device having at least one protruding knob shaped and having surface area designed to allow the palm of the hand of the user to cover the knob while allowing just the fingers of the hand to curl under the edges of the dome shape during grip strengthening exercises.

It is yet further desirable to provide an exercise device that provides resistance to muscular movement without the necessity of additional weights or exercise devices while allowing the user to experience a full range of motion utilizing the legs and lower body, while simultaneously providing the user with the benefits of stability training.

It is yet further desirable to provide an exercise device that allows a user to work out with a lighter weight with the same amount of muscle fiber recruitment used in a standard heavier weight, thereby reducing stress on joints and tendons;

It is yet further desirable to provide an exercise device that allows for full range of motion exercises and eliminates the danger of falling or slipping inherent to positional stability devices.

It is yet further desirable to provide an exercise device capable of being used by a variety of users and exercises by varying the amount of water fill, thereby reducing cost and storage space.

It is yet further desirable to provide an exercise device that will not cause damage to users or property when dropped or slammed as would an iron weight.

It is yet further desirable to provide an exercise device that can be shipped unfilled and, therefore, much less expensively than heavier weights and does not have the high maintenance costs associated with more complicated pieces of equipment.

It is yet further desirable to provide an exercise device that is relatively inexpensive and of an easily variable weight, which can be used in class settings, increasing the revenue stream of fitness and rehabilitative facilities.

It is yet further desirable to provide an exercise device that is an "all-in-one" device that, in addition to recruiting more muscle fiber in order to stabilize the weight during exercise, also forces the minute changes in body positioning required to complete an exercise correctly, which in turn increases a user's awareness of where their body is in space (proprioceptive awareness), and causes neuromuscular coordination and balance to become more efficient and precise.

It is still yet further desirable to provide an exercise device that may be used to treat a variety of body parts during all phases of rehabilitation, such as proprioceptive/kinesthetic awareness, co-contraction and neuromuscular reeducation during early phases of rehabilitation; neural adaptation, strength and joint stabilization training for all body parts throughout the kinetic chain during intermediate phases of rehabilitation; and power and plyometric training, sports specific movements, anaerobic conditioning and muscular endurance during functional training/advanced phase of rehabilitations.

SUMMARY OF THE INVENTION

In general, in a first aspect, the invention relates to an exercise device having an outer membrane forming a generally spherical, water-tight interior compartment capable of being filled with a sufficient volume of a destabilizing liquid, namely water, to impose a workload on a user's body during exercise. The outer membrane is constructed of a moldable, non-rupturable, thermoplastic polymer material having a sufficient durometer, tensile strength and density to allow the exercise device to be used in dynamic exercises when filled with the destabilizing liquid without tearing, bursting, rupturing or leaking. In addition, the outer membrane is constructed having no internal bladder, baffles or other means to stabilize or impede movement of the destabilizing liquid within the interior compartment, resulting in a predictable direction of flow of the destabilizing liquid, allowing the user to adjust for an anticipated direction of flow of the destabilizing liquid during the exercise with the exercise device. The exercise device also includes a handle and/or a knob integrated with an exterior surface of the outer membrane. An inlet port provides for fluid communication with the interior compartment of the exercise device formed by the outer membrane. The destabilizing liquid provides weight resistance to muscular movement in order to build muscle and provides destabilization of the exercise device as an aid in improving the user's balance and coordination by working the user's stabilizing muscles.

The exercise device of the outer membrane, the handle and the knob can form a unitary, contiguous exercise device. The outer membrane may be transparent or translucent through which the volume of the destabilizing liquid contained within the interior compartment of the exercise device can be discerned. Additionally, the outer membrane can have a density range of approximately 0.040 to approximately 0.050 lbs./cubic inch, namely approximately 0.42 to approximately 0.43 lbs./cubic inch, with a minimum tensile yield strength of approximately 2500 lbs./square inch minimum and a durometer range of approximately 40 to approximately 90 Shore A, namely approximately 50 to approximately 60 Shore A. Moreover, the outer membrane of the exercise device is fairly rigid and not stretchable, flexible or collapsible to a significant degree.

The interior compartment of the exercise device formed by the outer membrane can have a fluid capacity of approximately 5.57 gallons. The exterior surface of the outer membrane, the handle and/or the knob can be textured to provide for increased grip. The exterior surface of the outer membrane may include horizontal marking lines to indicate the weight of the exercise device with differing volumes of the destabilizing liquid.

Further, the handle and/or the knob may be constructed of a textured, moldable, polymer material having a density and durometer similar to that of the outer membrane. The handle and the knob can be attached at diametrically opposite points on the exterior surface of the outer membrane. The exercise device may include handles integrated to the exterior surface of the outer membrane at approximately 90 and approximately 180 degree orientations relative to each other, two handles integrated in diametric opposition to each other on the sides of the exterior surface of the outer membrane, or a first handle and a second handle attached at antipodal points on the exterior surface of the outer membrane and a third handle attached along a great circle arc between the antipodal points on the exterior surface of the outer membrane.

The knob of the exercise device may be mushroom-shaped having a stem portion that widens to a dome portion. The dome portion of the knob may be sized to allow the palm of the user's hand to cover the knob while allowing just the fingers of the user's hand to curl under the dome portion during grip strengthening exercises resulting in less ergonomic grip, forcing the user to directly engage the smaller muscle groups of the flexor carpi radialis, flexor carpi ulnaris and/or brachioradialis of the forearms and hands. The stem portion of the knob elevates the dome portion away from the exterior surface of the outer membrane a distance sufficient to allow the fingers of the user's hand to curl under the dome. The exercise device may include knobs integrated with the exterior surface of the outer membrane at approximately 90 and approximately 180 degree orientations relative to each other or a first protruding knob and a second protruding knob attached at antipodal points on the exterior surface of the outer membrane and a third protruding knob along a great circle arc between the antipodal points on the exterior surface of the outer membrane.

The inlet port of the exercise device may be an air valve in fluid communication with the interior compartment for insertion or removal of an amount of air into the interior compartment in order to eliminate any minor dimpling of the outer membrane. The inlet port may also be a water port in fluid communication with the interior compartment to fill or empty the interior compartment with the destabilizing liquid. The water port can be recessed into the exterior surface of the outer membrane and further comprises a rounded edge in order to eliminate any cutting or discomfort from the edge when closing the water port or during exercise with the exercise device. The water port may include a receptacle having internal tapered screw threads, a plug having external treads similar to the screw threads of the receptacle, and a gasket capable of being placed intermediate of the mating surfaces of the receptacle and the plug to form a seal to prevent leakage of the destabilizing liquid from the interior compartment.

The outer membrane of the exercise device may have a flattened side, one end of each of two pieces of a strap secured to oppose edges of the flattened side and opposite free ends of the two pieces of the strap provided with hook and loop fasteners to allow the strap to secure the exercise device to the user's limbs. The flattened side and/or the strap may be padded. The exercise device can further include two shoulder straps secured to the exterior surface of the outer membrane in spaced apart relationship so that each strap forms a loop for receiving the arm of the user, each shoulder strap secured to a separate horizontal chest strap via one end of the horizontal chest strap, and an opposite free end of each of the chest straps provided with a hook and loop fastener. Each of the shoulder straps may be formed by two pieces that are connected by an adjustment mechanism for adjusting the length of the shoulder strap.

Figure 1:
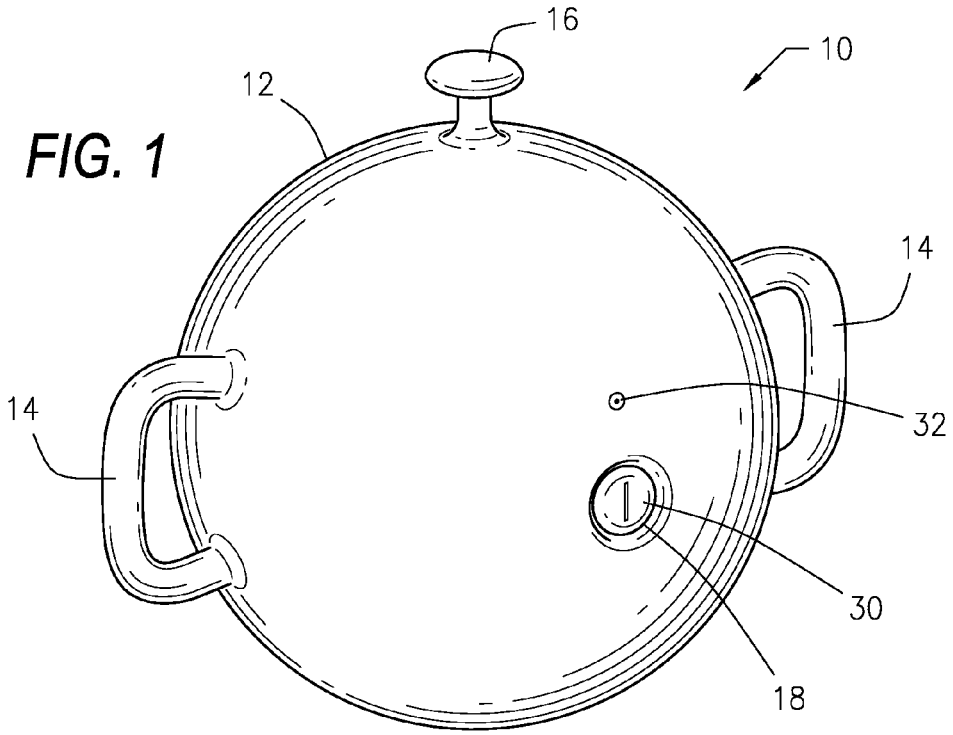
FIG. 1 is a perspective view of an example in accordance with an illustrative embodiment of the exercise device disclosed herein.
Figure 2:
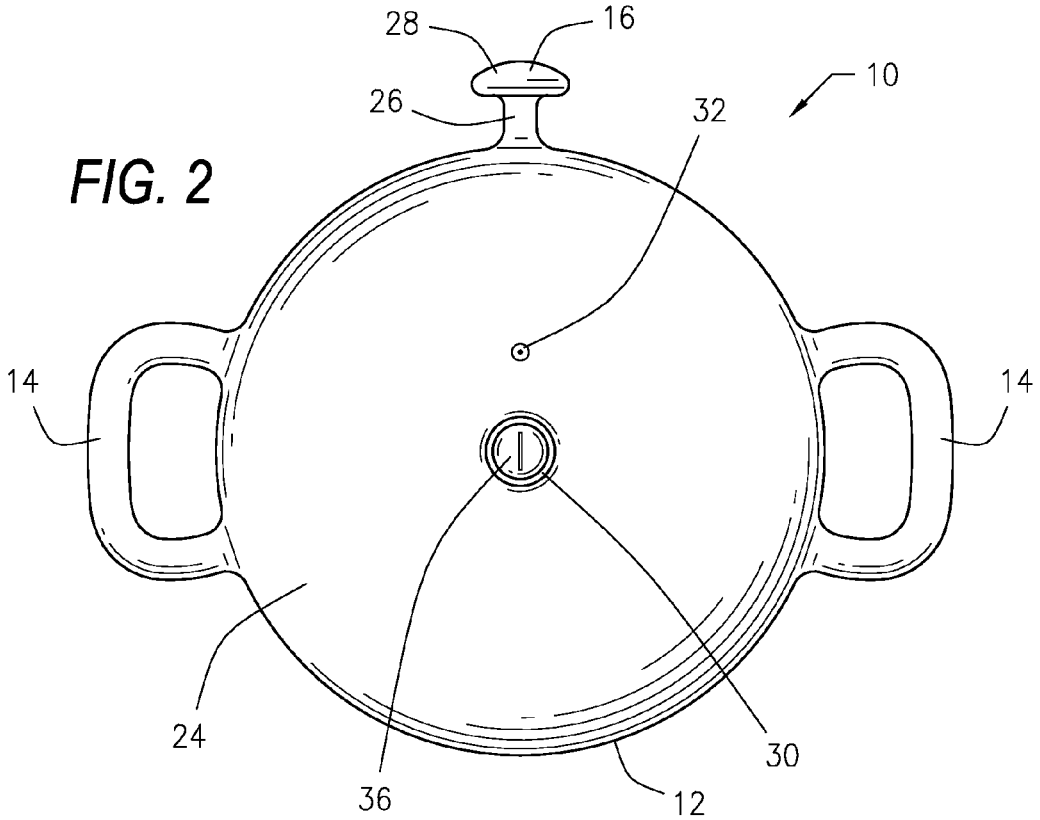
FIG. 2 is a front view of the exercise device shown in FIG. 1.
Figure 3:
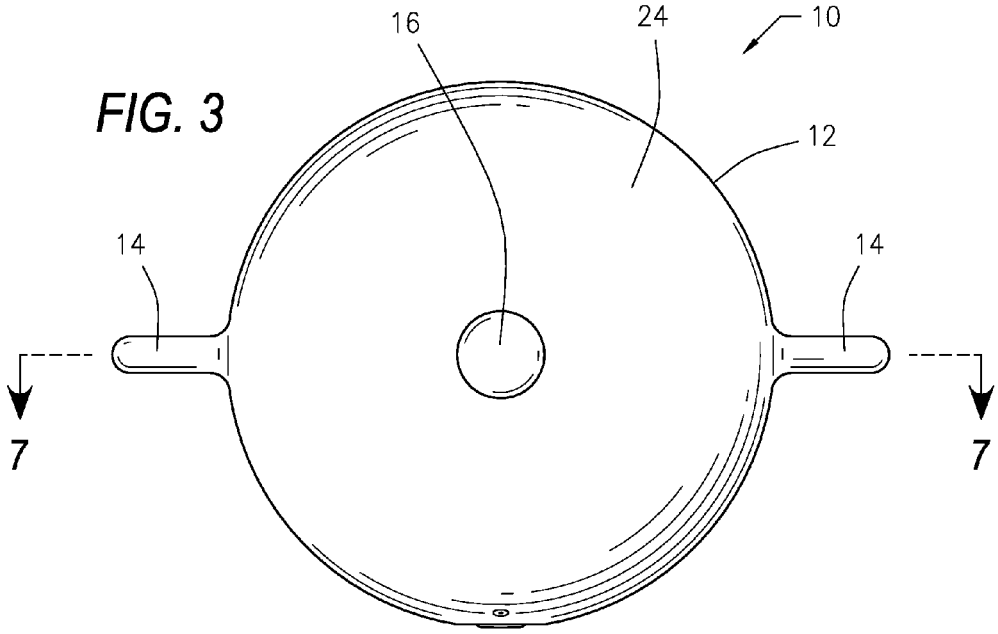
FIG. 3 is a top view of the exercise device shown in FIG. 1.
Figure 4:
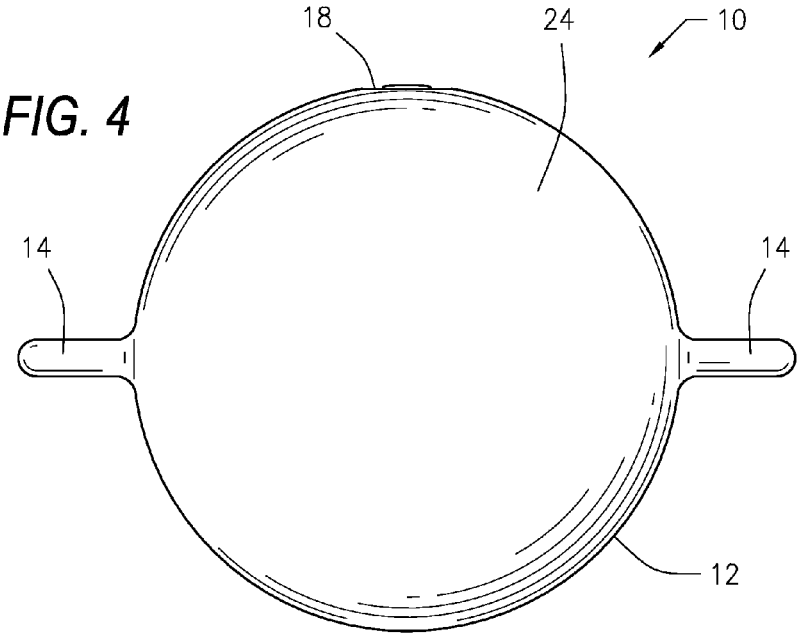
FIG. 4 is a bottom view of the exercise device shown in FIG. 1.
Figure 5:
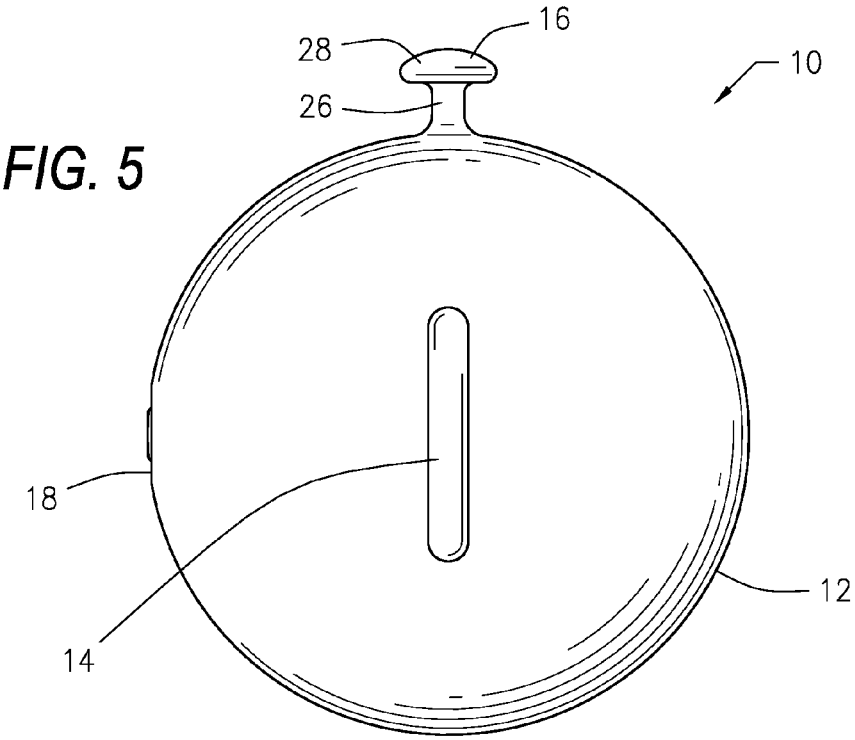
FIG. 5 is a side view of the exercise device shown in FIG. 1.
Figure 6:
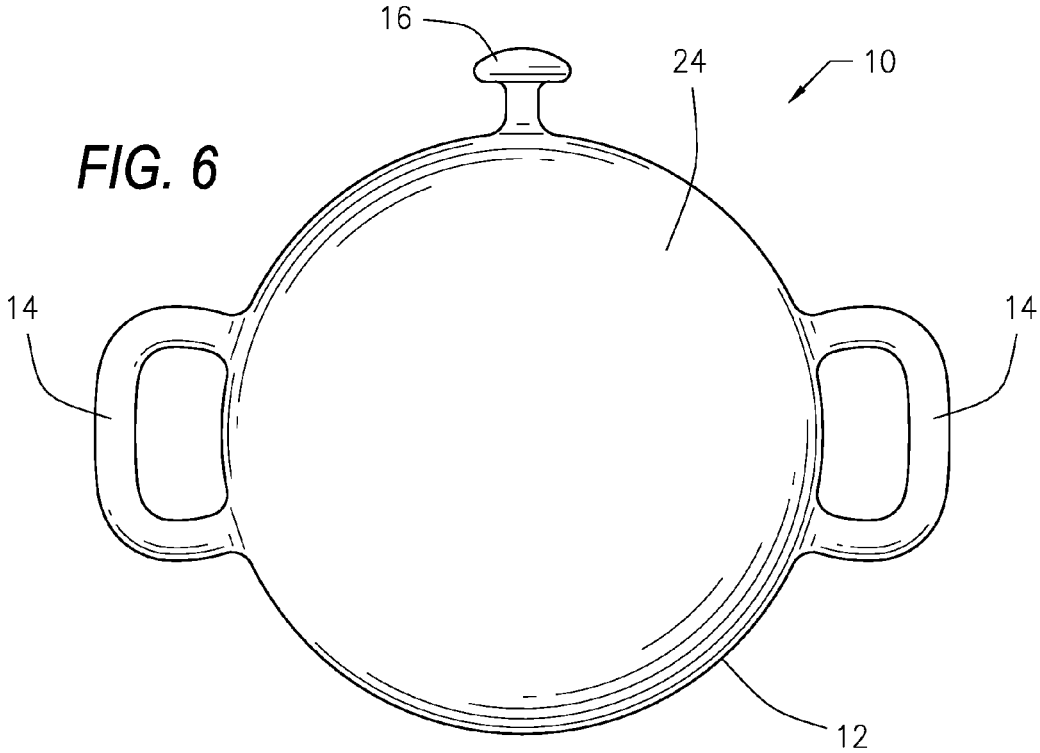
FIG. 6 is a rear view of the exercise device shown in FIG. 1.
Figure 7:
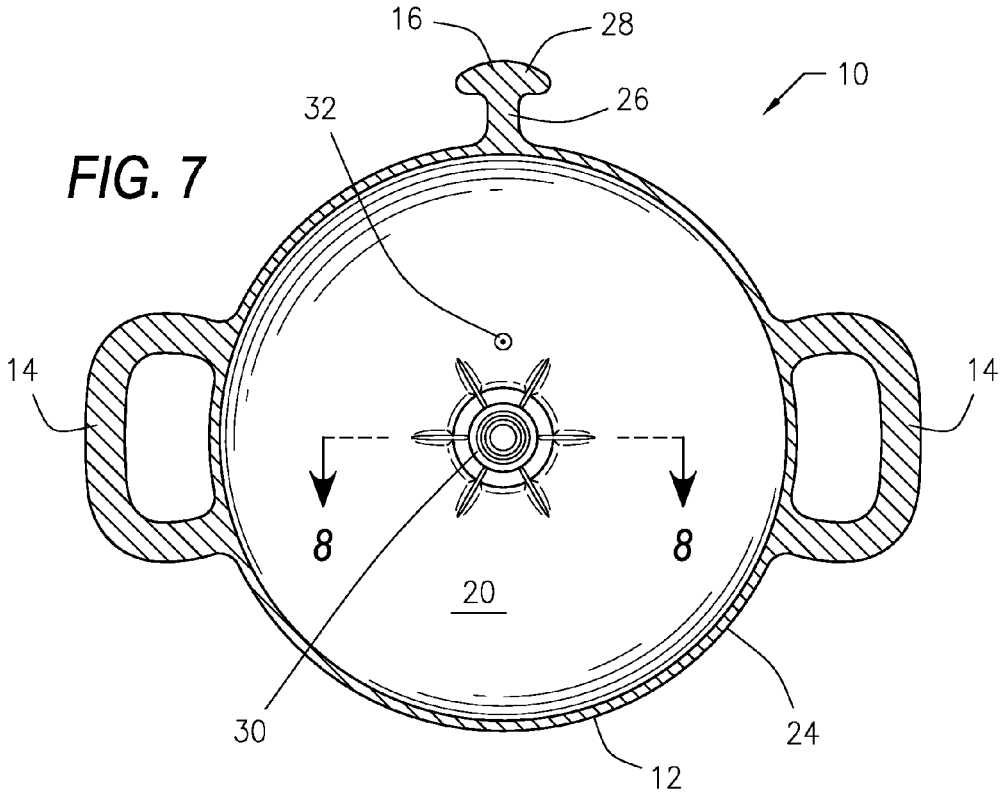
FIG. 7 is a cross-sectional view along line 7-7 of the exercise device shown in FIG. 3.

Other advantages and features will be apparent from the following description and from the claims.

DETAILED DESCRIPTION OF THE INVENTION

The devices and methods discussed herein are merely illustrative of specific manners in which to make and use this invention and are not to be interpreted as limiting in scope.

While the devices and methods have been described with a certain degree of particularity, it is to be noted that many modifications may be made in the details of the construction and the arrangement of the components and/or steps without departing from the spirit and scope of this disclosure. It is understood that the systems and methods are not limited to the embodiments set forth herein for purposes of exemplification.

Referring to the figures of the drawings, wherein like numerals of reference designate like elements throughout the several views, and initially to FIGS. 1 through 6, an exercise device 10 comprises an outer membrane 12, at least one handle 14, and at least one inlet port 18. The exercise device 10 may also include at least one knob 16. The outer membrane 12 forms a water-tight interior compartment 20 capable of being fluidly filled with a destabilizing liquid 22 via the inlet port 18. The destabilizing liquid 22 serves the dual purpose of providing weight resistance to muscular movement in order to build muscle and providing destabilization of the exercise device 10 as an aid in improving the user's balance and coordination by working the user's stabilizing muscles. The handle 14 and the knob 16 are attached to an exterior surface 24 of the outer membrane 12, and can be molded as one piece with the outer membrane 12 during construction of the exercise device 10 to ensure the handle 14 and/or the knob 16 do not tear or separate from the exercise device 10 during dynamic exercise. As such, the exercise device 10 may be constructed as a unitary, contiguous device formed by the outer membrane 12, the handle 14 and the knob 16.

The free flow of destabilizing liquid 22, such as water, within the interior compartment 20 of the exercise device 10 creates a consistent, predictable and controlled instability, which coupled with the ergonomic grip of the handle 14 and/or the knob 16 and the spherical shape and texturing of the outer membrane 12, allow the device 10 to be thrown and caught safely even while containing significant volumes and weight of destabilizing liquid 22. Further, the exercise device 10 provides resistance to muscular movement without the necessity of any additional devices while allowing the user to experience a full range of motion utilizing the legs and lower body, while simultaneously providing the user with the benefits of stability training.

The outer membrane 12 is constructed of a moldable material, such as a thermoplastic polymer (e.g., polyethylene, polypropylene, polystyrene, polyvinyl chloride and polytetrafluoroethylene). The material of the outer membrane 12 may be transparent or translucent in order for the user, such as an athlete or patient, to be able to discern the volume of destabilizing liquid in the exercise device 10. The outer membrane 12 of the exercise device 10 is non-rupturing having a sufficient durometer and density to allow the exercise device 10 to be used in dynamic slamming and throwing exercises while filled with destabilizing liquid 22 without tearing, bursting, rupturing or leaking. For example, the outer membrane 12 of the exercise device 10 has a density range of approximately 0.040 to approximately 0.050 lbs./cubic inch, particularly 0.42 to 0.43 lbs./cubic inch, with a minimum tensile yield strength of approximately 2500 lbs./square inch minimum and a durometer range of approximately 40 to 90 Shore A, particularly 50 to 60 Shore A. These parameters of the exercise device 10 result in a fairly rigid outer membrane 12, which holds its basic shape without insertion of a filler substance, such as air, water or sand, and which is not stretchable, flexible or collapsible to any significant degree. In order to gain any stretchability or flexibility in the exercise device 10, the durometer and density of the outer membrane 12 would have to be altered, resulting in a device that could not withstand dynamic exercise while containing large volumes of the destabilizing liquid 22 without bursting, tearing or rupturing. Thus, the exercise device 10 is not collapsible due to the density and durometer from which it is constructed in order to ensure the device 10 can withstand dynamic throwing and slamming exercises while containing up to about 5.5 gal. (approximately 45 lbs.) of destabilizing liquid 22 weight without bursting, rupturing or tearing. While the exercise device 10 is not stretchable, flexible or collapsible to any significant degree, the device 10 remains sufficiently soft to prevent damage or injury if dropped by the user, but cannot be used as a stretching or flexing device without losing the durability needed to withstand the force generated during dynamic exercise using the maximum volume of destabilizing liquid 22.

The exercise device 10 can be constructed in various sizes, such as approximately 14 inches or approximately 8 to 9 inches in diameter. With a 14 inch diameter, the outer membrane 12 of the exercise device 10 has a maximum interior fluid capacity of approximately 5.57 gallons. When filled with the maximum volume of destabilizing liquid, the exercise device 10 should be able to withstand up to approximately 1,300 ft/lbs. of force generated during dynamic exercise without bursting, tearing, rupturing or leaking. With an 8 to 9 inch diameter, the exercise device 10 can be used for therapy and rehabilitation purposes, having a 2 lb. maximum starting weight for post-injury and post-operative rehabilitation.

The exercise device 10 is generally spherical in shape in order to provide the largest possible gripping surface during throwing and catching exercises and to maintain a predictable flight path during those exercises. A rectangular or cylindrical object containing significant volume of destabilizing liquid 22 would be unpredictable in flight, and provide a smaller or irregular gripping surface during same exercises, with the possibility of injury to the user.

The exercise device 10 does not include a bladder within the interior compartment 20 formed by the outer membrane 12 to ensure that the destabilizing liquid's 22 movement is unimpeded, resulting in a predictable direction of flow, allowing the user to adjust for the anticipated direction of flow during the performance of exercise. Likewise, the interior compartment 20 does not contain baffles or other means to stabilize the destabilizing liquid 22 because the inertia of the destabilizing liquid 22 is utilized throughout the exercise to increase strength, proprioceptive awareness and balance. Ideally, the exercise device 10 is not be filled beyond 90% of the interior fluid capacity so that the benefits of the inertia are not eliminated because the destabilizing liquid 22 does not have sufficient space in which to generate movement.

In addition, the exterior surface 24 of outer membrane 12 of the exercise device 10 may be textured, such as by sand blasting during manufacturing, in order to provide better gripping for athletes and patients during exercises in which they are not utilizing the handle 14 or knob 16 of the exercise device 10. Further, the exterior surface 24 of the outer membrane 12 may include horizontal marking lines 40 to indicate the weight of the exercise device 10 with differing volumes of destabilizing liquid. The marking lines 40 may be engraved on or protrude from the exterior surface 24 of the outer membrane 12 of the exercise device 10.

The handle 14 may be a plurality of handles, such as two (2) handles constructed of a textured, moldable, polymer material attached in diametric opposition to each other on the sides of the exterior surface 24 of the outer membrane 12 of the exercise device 10. The polymer material forming the handles 14 has a density and durometer similar to that of the outer membrane 12, namely a density range of approximately 0.040 to approximately 0.050 lbs./cubic inch, particularly 0.42 to 0.43 lbs./cubic inch and a durometer range of approximately 40 to 90 Shore A, particularly 50 to 60 Shore A. The handles 14 can be constructed as one unitary and contiguous piece with the outer membrane 12, or alternatively, can be made separately and then attached to the external surface 24 of the outer membrane 12 during the manufacturing process of the exercise device 10. When the exercise device 10 is constructed as one unitary and contiguous piece with the handles 14, the handles 14 will not tear or separate from the external surface 24 of the outer membrane 12 during dynamic exercises with the exercise device 10 in which the inertial force of a volume of the destabilizing liquid 22 weighing up to 45 lbs. may be utilized. Also similar to the external surface 24 of the outer membrane 12, the handles 14 may be textured to reduce slippage that can occur when utilizing a slick, nontextured polymeric material, particularly when the user is perspiring heavily and the external surface 24 of the exercise device 10 becomes wet. The handles 14 may be arched in form, having an outer width of approximately 6.10 inches and an inner width of approximately 3.81 inches.

The knob 16 may be a mushroom-shaped protrusion constructed of textured, moldable, polymer material attached on the exterior surface 24 of the outer membrane 12 of the exercise device 10. The polymer material forming the knob 16 has a density and durometer similar to that of the outer membrane 12 and the handle 14, namely a density range of approximately 0.040 to approximately 0.050 lbs./cubic inch, particularly 0.42 to 0.43 lbs./cubic inch and a durometer range of approximately 40 to 90 Shore A, particularly 50 to 60 Shore A. Also similarly to the handle 14, the knob 16 can be constructed as one unitary and contiguous piece with the outer membrane 12, or alternatively, can be made separately and then attached to the external surface 24 of the outer membrane 14 during the manufacturing process of the exercise device 10; however, when constructed as one unitary and contiguous piece with the outer membrane 12, the knob 16 will not tear or separate from the external surface 24 of the outer membrane 12 during dynamic exercises with the exercise device 10. Again also similar to the handle 14, the knob 16 may be textured to reduce slippage that can occur when utilizing a slick, nontextured polymeric material, particularly when the user is perspiring heavily and the exercise device 10 becomes wet.

The knob 16 may comprise a stem portion 26 being approximately 0.70 to approximately 1.20 inches in diameter, widening to a dome portion 28 being approximately 2.25 inches in diameter, which is the approximate diameter needed to allow the palm of an average sized hand to cover the knob 16 while allowing just the fingers of the hand to curl under the edges of the dome portion 28. The knob 16 may be utilized during grip strengthening exercises because the reduced surface area, as opposed to the handle 14 in which the entire hand can wrap around, and the resulting less ergonomic grip, force the user to directly engage the smaller muscle groups of the flexor carpi radialis, flexor carpi ulnaris and/or brachioradialis of the forearms and hands. During a weight bearing exercise with the handle 14, these muscles of the forearms and hands act merely as extensions of the major muscle groups in the arms and torso, with minimal recruitment of the aforementioned smaller muscle groups. Forcing the smaller muscle groups to compensate for the reduced surface area and less ergonomic grip by directly engaging them leads to greater grip strength, which is particularly useful to rock and mountain climbers, gymnasts and post-injury or post-operative patients rehabilitating from hand and forearm injuries.

The inlet port 18 can comprise a water port 30 and/or an air valve 32. The air valve 32 would accept a standard needle valve (not shown) for insertion of a small amount of air into the interior compartment 20 in order to eliminate any minor dimpling of the outer membrane 12 of the exercise device 10. The water port 30 provides for fluid communication with the interior compartment 20 of the outer membrane 12 of the exercise device 10, and in particular provides an access to fill or empty the interior compartment 20 of the exercise device 10 with the destabilizing liquid 22. As illustrated, the water port 30 may be recessed into the exterior surface 24 of the outer membrane 12 and include a rounded edge in order to eliminate cutting or discomfort from the edge when closing the water port 30 or during exercise with the device 10. The water port 30 may include a receptacle 34 having internal tapered screw threads, a plug 36 having external treads similar to the screw threads of the receptacle 34. The plug 36 is constructed of a moldable, polymer material with a durometer of approximately 70 to 80 Shore A. The plug 36 is removably engaged with the receptacle to seal the destabilizing liquid 22 within the interior compartment 20. The plug 36 may have a cap with grooved edges and a slotted top. In addition, a gasket 38 may be placed intermediate of the mating surfaces of the receptacle 34 and the plug 36 to form a seal to prevent leakage of the destabilizing liquid 22 from the interior compartment 20 of the exercise device 10. The gasket 38 may be constructed of any suitable neoprene rubber, cork, polymer or other marital that will hold tension under compression against the plug 36 and the receptacle 34. For example during operation, a water hose or water faucet (not shown) can be attached to the water port 30 via the receptacle 34 to fill the interior compartment 20 of the exercise device 10 with water as the destabilizing liquid 22. Once the exercise device 10 is filled to the desired level, the water hose or water faucet is removed from the threaded receptacle 34 and a threaded plug 36 is inserted into the threaded receptacle 34 to seal the water port 30 and prevent leakage of destabilizing liquid 22 from the interior compartment 20 of the exercise device.

Figure 9:
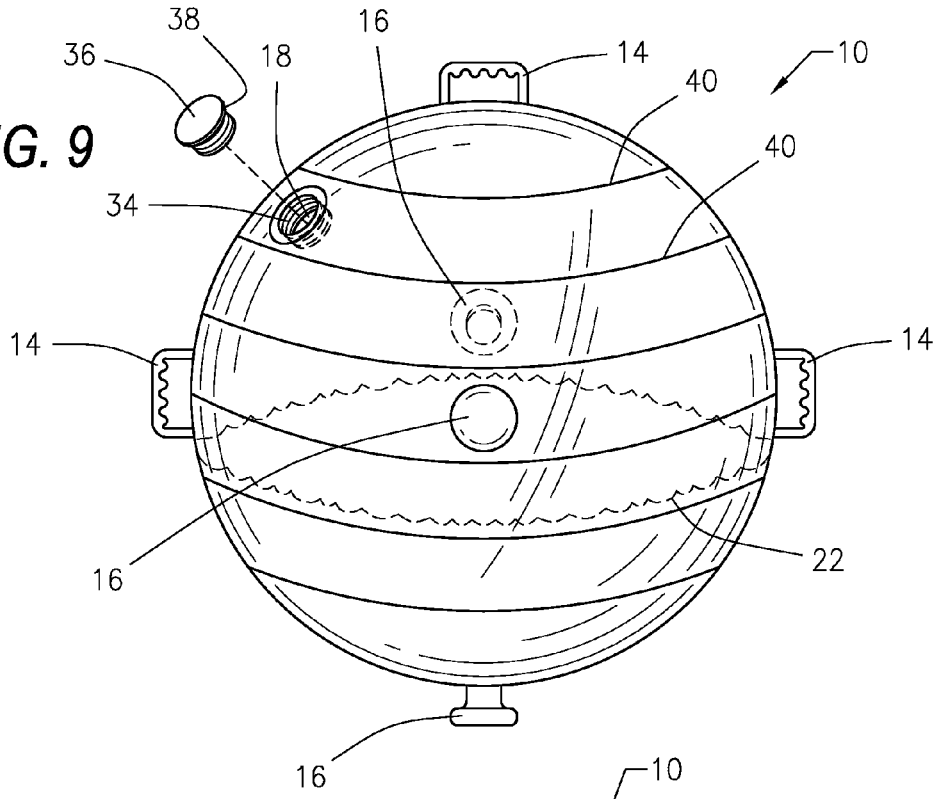
FIG. 9 is a perspective view of another example of an exercise device in accordance with an illustrative embodiment of the exercise device disclosed herein.

Referring now to FIG. 9, the exercise device 10 includes a plurality of handles 14 and a plurality of knobs 16 that can be gripped by the user's hands or feet. As illustrated in FIG. 9, the plurality of handles 14 may be provided attached to the exterior surface 24 of the outer membrane 12 at approximately 90 and approximately 180 degree orientations relative to each other, and in particular, a first handle and a second handle may be attached at antipodal points on the exterior surface 24 of the outer membrane 12 and a third handle may be attached along a great circle arc between the antipodal points on the exterior surface 24 of the outer membrane 12. Similarly, the plurality of knobs 16 may be provided attached to the exterior surface 24 of the outer membrane 12 at approximately 90 and approximately 180 degree orientations relative to each other, and in particular, a first knob and a second knob may be attached at antipodal points with a third knob attached along a great circle arc between the antipodal points on the exterior surface of outer membrane 12. One of the handles 14, such as the third handle, and one of the knobs 16, such as the third knob, may be attached at diametrically opposite points on the exterior surface 24 of the outer membrane 12. This relative orientation of the handles 14 and the knobs 16 provide maximum flexibility in use of the exercise device 10. Moreover, the handles 14 can be used as attachment points for attaching additional exercise equipment, such as bungee cords (not shown) to the exercise device 10 to increase the uses that can be made of the exercise device 10.

As stated above, the exercise device 10 is not designed to provide positional instability, but rather is constructed of a polymeric and non-rupturing material designed to hold a sufficient weight of the destabilizing liquid 22 to impose a workload, such as while being lifted, pushed, pulled, thrown, slammed or swung, during physical therapy, conditioning or training in order to provide resistance to muscular movement through the antagonistic weight of the destabilizing liquid 22, while at the same time harnessing the momentum of the destabilizing liquid 22 to force the user to engage the core supportive muscles in order to maintain balance to counteract the antagonistic inertial force of the destabilizing liquid 22 during the movement. The exercise device 10 provides for an inherently unstable exercise device that can be lifted, pushed, pulled, thrown, swung or otherwise utilized in a full range of motion in lieu of traditional weights, with the movement of the destabilizing liquid 22 within the exercise device 10 creating the need for balancing and adjusting movements by the user, and the weight of the destabilizing liquid 22 providing resistance to muscular movement, and the momentum of the weighty destabilizing liquid 22 moving in a predictable direction necessitating counter resistance by the user, with the counter resistance by the user adding difficulty to the exercise in terms of both balance and strength conditioning.

The exercise device 10 utilizes the destabilizing liquid 22 to simultaneously utilize both the weight and instability of such destabilizing liquid 22 for rehabilitative and fitness purposes. Prior art devices which use water as a filler utilize the water as either stabilizing ballast, or provided for baffling elements to eliminate the movement of water within the device. In contrast, the exercise device 10 captures the fluid motion of the destabilizing liquid's 22 predictable momentum in the direction of movement (inertia) to increase the difficulty of exercise in terms of both balance and strength. As described above, the exercise device 10 is constructed of a single, open interior compartment 20 having no internal baffles to impede antagonistic inertial force of the destabilizing liquid 22 within the interior compartment 20 to enable the user to utilize the momentum of destabilizing liquid 22 within the exercise device 10 for fitness and rehabilitation. The purposeful exploitation of the inertia of destabilizing liquid 22 to enhance fitness and rehabilitative exercise is unique to the exercise device 10 and provides a means of meeting fitness and rehabilitative training goals where the use of heavier, more dangerous and potentially damaging traditional weights is risky or inappropriate.

The exercise device 10 is utilized to rapidly progress patients through their rehabilitation process. The exercise device 10 may be used to treat a variety of body parts, both upper and lower extremity as well as spine. Specifically, for shoulder patients, both operative and non-operative, the exercise device 10 can be used in early phases of rehabilitation for proprioceptive/kinesthetic awareness, co-contraction and neuromuscular reeducation, performing "super slow" exercises in a variety of planes without moving the destabilizing liquid 22. Gravity positions have been altered as well to add an additional variable to exercise routines. In addition, the exercise device 10 may be utilized by spine patients with an extreme emphasis on core stability and no trunk movement, and/or a combined program of spine and shoulder may be integrated.

During intermediate phases of rehabilitation, the exercise device 10 can be utilized for neural adaptation, strength and joint stabilization training for all body parts throughout the kinetic chain, from the ground upward: ankle, knee, hip, trunk, shoulder, elbow, and wrist. In particular, the exercise device 10 can be used during rhythmic stabilization techniques with short arc movements of the exercise device 10, gradually increasing the arc of movement and thereby the forces of inertia for treatment progression with upper extremity injuries. Closed kinetic chain exercises with the exercise device 10 as the unstable destabilizing liquid 22 is extremely effective in treating lower extremity injuries, building joint stabilization, balance and coordination during intermediate phases of rehabilitation with the spine as an additional (or primary) benefit. Clinicians typically start with short arc, planar movement patterns and move to long arc, multi-planar patterns. The knob 16 can be used for wrist/forearm strengthening with turning and gripping motions.

In progressing patients to the functional training/advanced phase of rehabilitation, the exercise device 10 is utilized in a variety of ways including power and plyometric training, sports specific movements, anaerobic conditioning and muscular endurance. In addition, the exercise device 10 can be used in closed chain, open chain, functional and sports specific movement patterns with an emphasis on stabilization, controlled movement and refining technique to prevent reinjury.

In summary, by combining the elements of joint stabilization, kinesthetic awareness, neuromuscular reeducation, neural adaptation, strength, endurance, balance and coordination, the exercise device 10 can be used in all phases of the rehabilitation process. The exercise device 10 attains the ultimate goals in a rehabilitation setting, namely functional improvement, performance enhancement and injury prevention.

Figure 10:
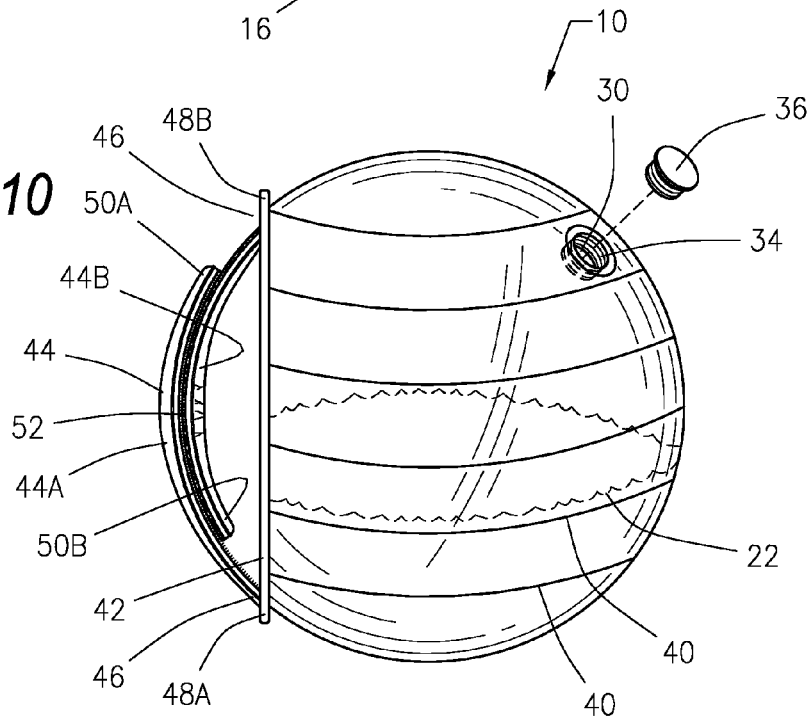
FIG. 10 is a perspective view of yet another example of an exercise device in accordance with an illustrative embodiment of the exercise device disclosed herein.
Figure 11:
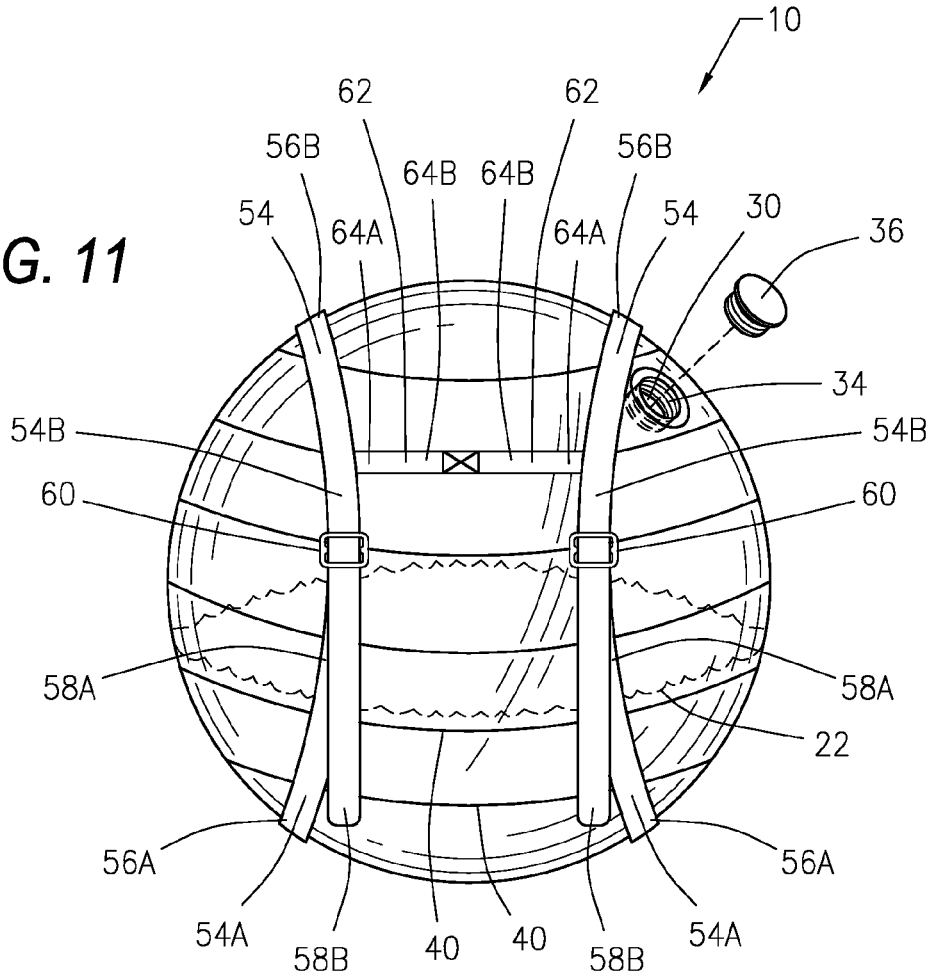
FIG. 11 is a perspective view of still yet another example of an exercise device in accordance with an illustrative embodiment of the exercise device disclosed herein.

Referring now to FIGS. 10 and 11, and initially to FIG. 10, the exercise device 10 may include a flattened padded side 42, which can be secured to the user's limbs by a padded strap 44. As illustrated, the padded strap 44 can be constructed in two (2) pieces 44A and 44B with one end 46 of each piece 44A and 44B attached to opposite sides 48A and 48B of the flattend padded side 42 and with an opposite free end 50A and 50B of each piece 44A and 44B provided with mating hook and loop fastening means 52 so that the two free ends 50A and 50B can be secured together via the hook and loop fastening means 52 to secure the exercise device 10 to a user's limbs.

While FIG. 10 illustrates the exercise device 10 without handles 14 and knobs 16, one or more of these features may be included.

Referring now to FIG. 11, the exercise device 10 may be provided with a pair of shoulder straps 54 that are used to secure the device 10 to a user's back in a manner similar to a backpack. Each shoulder strap 54 can be constructed of two (2) pieces 54A and 54B, with one end 56A and 56B of each piece 54A and 54B secured in spaced apart locations on the exercise device 10 and opposite free ends 58A and 58B of pieces 54A and 54B engaging an adjustment means 60 for adjusting the length of loops of shoulder straps 54 formed by the two pieces 54A and 54B. Each of the shoulder straps 54 may be provided with a horizontal chest strap 62 that attaches via one end 64A of the horizontal chest strap 62 approximately perpendicularly to its associated shoulder strap 54 and roughly ⅓ of the distance down on the shoulder strap 54. Opposite free ends 64B of the pieces 64A and 64B of the chest strap 62 may be provided with hook and loop closure means (not shown) that removably engage each other to secure the horizontal chest strap 62 around the user's chest after the user has inserted his arms through the loops formed by the two shoulder straps 54. The pieces 64A and 64B of the horizontal chest strap 62 serve to prevent the shoulder straps 54 from moving apart and slipping off of the user's shoulders as the user carries the exercise device 10 space on their back. The shoulder straps 54 may be padded and the exercise device 10 may be provided with a flattened padded side (not shown) similar to the flattened padded side illustrated in FIG. 10, for engagement with the user's back in order to make it more comfortable for the user to carry the exercise device 10 on their back. Again, while FIG. 11 illustrates the exercise device 10 without handles 14 and knobs 16, one or more of these features may be included.

EXAMPLES

The exercise device and use thereof disclosed herein is further illustrated by the following example exercises, which are provided for the purpose of demonstration rather than limitation.

Level 1 Exercises

Example 1

Squats

The user holds the exercise device parallel with the floor throughout this movement with a slight bend at the elbow. The user's feet are placed at shoulder width, keeping the knees and ankles aligned, the user stands erect while keeping the chest high, shoulders back and head up. The squatting movement begins with the hips, and not at the knees, and the user squats down in a motion as if attempting to sit in a chair, keeping the back aligned and the upper body erect. The eccentric half of this exercise will end when the user's legs are at a 90 degree angle. The body is kept aligned, and the user should push through their heels, not toes, to finish the movement.

The primary agonist muscles involved in the squat are the quadriceps and gluteus maximus, as well as the hamstrings, deltoids and biceps being recruited as the synergist. By using the exercise device, the user adds the variable of controlling the inertia of the destabilizing liquid, which engages all of the core muscles and causes the entire body to stay engaged, thereby recruiting numerous muscle fibers that a traditional squat does not.

Example 2

Upright Rows

Beginning with a solid base, the user stands with feet shoulder width and slightly bent at the knees. The user grips the handle of the exercise device with both hands, allowing it to hang at arm's length, and pulls straight up towards the chin.

The primary agonist muscles involved with the upright row are the trapezius, anterior and lateral heads of the deltoid as well as the biceps working as the synergist. Controlling the unstable inertia created by the exercise device increases difficulty dramatically from stable weights. This requires an isometric contraction of muscle fibers throughout the entire body, requiring balance and stability.

Example 3

Curls

Starting with the exercise device at arm's length, the user keeps the core and base tight while contracting the exercise device up with the hand towards the shoulder and returns to starting position.

Aside from working the biceps as the user would do during a traditional curl with a dumbbell or kettlebell, the added variable of controlling the movement within the exercise device itself requires that the user engage the core stabilizing muscles to keep proper form and movement. Even the legs are receiving direct stimulus to help keep the user balanced while executing the movement.

Example 4

Lunges

The user of the exercise device starts this movement with the upper body erect holding the exercise device parallel to the floor with a slight bend in the elbows. The user steps out far enough that the forward leg makes a 90 degree angle at the bottom of the eccentric phase of each repetition, making sure that the knee does not push out in front of the foot. The user keeps the weight in the heels and not in the toes. After finishing the eccentric half of the repetition, the user should step forward, bringing the feet back to a position where they are together. The user should alternate legs each repetition.

The primary agonist muscles involved in the lunge are the quadriceps, gluteus maximus and hamstrings. Holding the exercise device engages the upper body from deltoids to biceps as well as keeping the core stabilizing muscles engaged to compensate for the inertia the exercise device presents.

Example 5

Lateral Raises

To execute this movement, the user will keep a solid base throughout the core and lower body. Holding onto the handle of the exercise device with a very slight bend in the elbow, the user will begin with the hand at the waist; extend the arm to the side, bringing the handle up until parallel with the floor and then back to the starting position.

The primary agonist muscle used during the concentric phase of this exercise will be the lateral head of the deltoid, with the trapezius being the main synergist muscle in this movement. During the eccentric phase, the controlled deceleration of the ball and the fluid within will require contracting muscle fibers throughout the entire body in order to establish balance and control.

Example 6

Pull Overs

The user will start this exercise lying in a supine position on a bench. Hold the exercise device with both arms fully extended straight up toward the ceiling. Inhale as the user brings the ball backwards until the arms are parallel with the bench. Exhale as the user starts the concentric phase of the repetition, bringing the ball back to the starting position.

The primary agonist and synergist muscles used during this exercise are the pectorals, lattisimus dorsi, abdominals and serratus. The exercise device recruits significantly more muscle fibers than a dumbbell or medicine ball traditionally used in this exercise due to the instability factor. This is also a great exercise for stretching this same group of muscles at the beginning or end of a workout.

Example 7

Chest Presses

Lying supine on the bench, the user will start by gripping the handles and holding the exercise device to the chest. Press upwards until the arms are fully extended and then bring back to the starting position.

The primary agonist muscles recruited during the chest press are the pectorals and front deltoids, and the triceps as the synergist. The added resistance of the exercise device's inertia requires considerably more muscle fiber recruitment through core stabilization than dumbbells or a kettlebell press.

Example 8

Tricep Extensions

The user starts this exercise with a shoulder width stance and a slight bend in the knees. The user's core is kept tight. The exercise device is held by the handle with one hand extended overhead. The user's arms are bent at the elbow, lowering the exercise device to the shoulder. Extend back to the starting position, moving only from the elbow to hand. Do not use any momentum.

In this exercise the primary agonist muscle being worked is the triceps. Balancing the inertia associated with the exercise device will require an isometric contraction throughout the entire body, engaging muscles from the legs to your core.

Example 9

Trunk Rotational Slams

The user holds the exercise device with both hands on one handle, keeping a shoulder width stance and a slight bend in the knees. The user will keep the back to a wall and a slight bend in the elbows. Rotate at the trunk in a lateral motion, striking the exercise device against the wall alternating right to left.

This exercise is very dynamic, mainly focusing on trunk rotation, with an emphasis on your obliques, serratus and abdominals. With the exercise device, the instability factor and sudden change of inertia causes the user to engage muscle fibers throughout the body from deltoids, biceps, hip flexors, pectorals and even causing muscle fiber recruitment throughout the legs to balance a solid foundation.

Example 10

Swings

The user keeps the feet a foot wider than shoulder width. Bend at the knees in a squatting motion, holding the exercise device by a handle between the legs. Start the concentric phase of the squat and swing the exercise device vertically up until the arm is parallel with the ground. Control the exercise device during the eccentric phase until the user is back at the starting position.

This is another dynamic exercise, with the primary agonist muscles being the quadriceps, hamstrings, gluteus maximus and anterior deltoids, while the forearms, trapezius and core muscles act as the synergists. With the deceleration and sudden change of inertia produced during the eccentric phase of this exercise, there is more focus on the abdominals and spinal erectors to help stabilize the core than with a traditional kettlebell swing.

Example 11

Step Ups

The user holds the exercise device by the handles close to the body with a 90 degree angle in the arms, keeping their elbows against their hips. The user steps onto the bench or plyo box. Step up pushing through the heel and not the toe, then back to the starting position.

The primary agonist and synergist muscles involved in the step up are the quadriceps, gluteus maximus, hip flexors and hamstrings, along with the biceps and deltoids to hold the exercise device. The change of inertia during both the concentric and eccentric phase of each repetition requires a greater number of muscle fibers to be recruited in order to stay balanced throughout the motion versus performing the exercise with a stable weight.

Example 12

Plyo Squat Jumps

The user holds the exercise device close to the chest and sets the feet shoulder width apart. The user stands erect with the chin up and shoulders back. The body is lowered in the same motion the user would use to execute a standard squat. At the lowest point of the eccentric phase, the user jumps as high as possible while keeping form. The user will land with a slight bend of the knees to cushion the landing. Reset and repeat.

This exercise is extremely dynamic in nature. The agonist muscles primarily involved are the quadriceps, gluteus maximus, gastrocnemius soleus and hamstrings, with the biceps, deltoids, and core working as the synergists. The added change of inertia from the exercise device requires constant tension in the abdominal section, as well as recruiting more muscle fibers than a standard plyometric squat jump. This exercise is great to increase anaerobic endurance.

Example 13

Anterior Raises

The user grips the handles of the exercise device with the arms hanging while standing with a stable foundation. The user keeps the arms extended and raises the exercise device in front until the arms are parallel with the floor.

The primary agonist and synergist muscles involved with this exercise are the anterior deltoid and the trapezius. The inertia of the exercise device throughout the concentric and eccentric phase of each repetition requires stabilization and balance, which recruits the quadriceps, gluteus maximus and hamstrings to engage muscle fibers, as well as keeping a tight core, which recruits the abdominals and spinal erectors.

Example 14

Bent Over Rows

The user grips the exercise device by the handles, places the feet shoulder width apart and squats down at the knees. Make sure the user's back is aligned at a 45 degree angle with the chin up and looking forward, letting the arms hang down fully extended. Initiate the rowing movement by bringing the elbows back to the sides until the exercise device touches the sternum. Lower the exercise device back to the starting position and repeat.

In this exercise the agonist muscles involved will be the lattisimus dorsi, teres major and teres minor. The synergist muscles are the rhomboids, spinal erectors, biceps and rear deltoids, as well as the lower body and core muscles that will be engaged to provide a solid base and control the inertia of the exercise device.

Example 15

Push Ups

The user starts this exercise with the feet and hands shoulder width apart in a prone position. While balancing the exercise device between the shoulder blades, lower the body slowly until the user's chest touches the floor. Press back up to the starting position.

The primary muscles used during a pushup, such as the pectorals, front deltoids and triceps, are still the main agonist and synergist muscles used here. The added benefit of the exercise device is that the user is required to balance the weight of the exercise device's resistance, which translates to a much higher number of muscle fiber recruitment in order to maintain balance and stabilize the core.

Example 16

Farmer's Walk

The user grips the handle of the exercise device in each hand, arms fully extended at the sides except for a slight bend in the elbows. Keep the core tight with the back erect and chin up. Walk as many steps back and forth as the user can.

This exercise recruits the core muscles in a highly functional exercise that is great for increasing anaerobic endurance, engaging the quadriceps, hamstrings, gastrocnemius, soleus, and deltoids, as well as increasing forearm grip strength. The added benefit of the exercise device destabilizing the athlete exponentially increases proprioceptive awareness and the number of muscle fibers recruited dramatically increases versus using a static weight.

Example 17

Flys

The user starts this exercise in a supine position on the bench, gripping the handle of the exercise device in each hand. The user keeps a slight bend in the elbows with the arms extended laterally to the sides. The hands are brought together above the user in a circular motion as if they were hugging somebody. Lower the exercise devices back down in the same motion reversed until the user is back to the starting position.

The primary agonist and synergist muscles engaged in this exercise are the pectoralis major, pectoralis minor, anterior deltoids and abdominals. The instability of the exercise device will greatly increase the recruitment of muscle fibers in the serratus and obliques.

Example 18

Wood Choppers

In this exercise the user will stand with feet shoulder width apart. Grip one handle of the exercise device with both hands. Bend at the knees and slightly forward, with the back aligned as if in a golf stance. With the arms extended, bring the exercise device up in a 45 degree angle above the shoulder, and then swing back down across the same 45 degree plane.

This exercise will greatly increase trunk rotational strength. The use of the exercise device will force the athlete to stabilize the inertia created and will relate more to sports performance than the same exercise with a static weight would. The primary agonist and synergist muscles involved are the deltoids, serratus, obliques, abdominals, pectorals, biceps and forearms.

Example 19

Back Extensions

The user grips the exercise device by both handles and holds it behind the neck. Keep the back aligned as the user bends forward at the hips. Keep the chin up, and bend forward 90 degrees and back up to the starting position.

The often neglected erector spinae muscles are the primary agonist muscles, with the gluteus maximus and hamstrings working as the synergist muscles. Holding an exercise device will also recruit the biceps, anterior deltoids, pectorals and abdominals. The use of the exercise device forces the body to recruit a much higher percentage of muscle fibers than a traditional hyperextension.

Example 20

Skydivers

The user lays down in a prone position with the arms extended in front with palms down. The exercise device should be held by each handle in an overhead extension, with a slight bend in the elbows. Lift the arms and legs 6 inches up from the floor. Hold the isometric contraction for a set amount of time.

This exercise will strengthen the erector spinae as well as engage muscle fibers in the lattisimus dorsa, rhomboids, teres major, teres minor and anterior deltoids, while increasing proprioceptive awareness throughout the body.

Example 21

Slams

The user holds both handles of the exercise device, standing with feet at shoulder width and the back aligned. Raise the exercise device up above the head and squat down as the user slams the exercise device to the ground. Pick the exercise device up and repeat.

This exercise is great for building anaerobic endurance. The added resistance of the exercise device versus a medicine ball, which is traditionally used in this exercise, requires the body to recruit a significantly higher percentage of muscle fibers. The primary agonist and synergist muscles involved are the quadriceps, hamstrings, gluteus maximus, biceps, deltoids and triceps as well as the core muscles that must engage throughout the entire movement to insure proper form and stability.

Example 22

Standing Overhead Presses

The user stands with a slight bend in the knees and the back erect, gripping both handles of the exercise device held at the chest. Press the exercise device towards the ceiling, and then back to the starting position.

This movement will build strength primarily in the agonist muscles, which are the deltoids, and triceps, as well as the synergist muscles of the pectorals and abdominals. The inertia of the exercise device will add a proprioceptive element not found with a traditional kettlebell overhead press.

Example 23

Overhead Throw and Catch

The user holds both handles of the exercise device with elbows at the sides and the exercise device at the chest. Start with a squat and, during the concentric phase of the repetition, throw the exercise device toward the ceiling; catch and repeat.

This exercise will work all of the muscles engaged in the Kamagon Squat (exercise #1), but the overhead throw at the end will explosively work the deltoids and triceps as the agonists and the pectorals and core as the synergist muscles. Catching the exercise device will build hand/eye coordination and proprioceptive awareness. This is commonly done with a medicine ball, but using the exercise device will add stability and balance, thus increasing muscle fiber engagement and work the serratus and obliques, which are not even addressed when using a medicine ball.

Example 24

Hand Off Exercise Device Around the Hips (Clockwise and Counterclockwise)

The user starts this exercise with feet shoulder width apart and a slight bend in the knees. Pass the exercise device clockwise around the body, passing the exercise device from one hand to another using one of the handles. After the desired number of repetitions the user will switch to counterclockwise.

This movement will primarily engage all the muscles of the core as both the agonist and synergist muscles, while building overall proprioceptive awareness. A high number of repetitions will also add a cardiovascular element. When using a kettlebell there is a lesser degree of stability training due to the static condition of the weight, as well as a greater risk of injury since a kettlebell is made of iron and unforgiving if it is dropped!

Example 25

Figure 8:
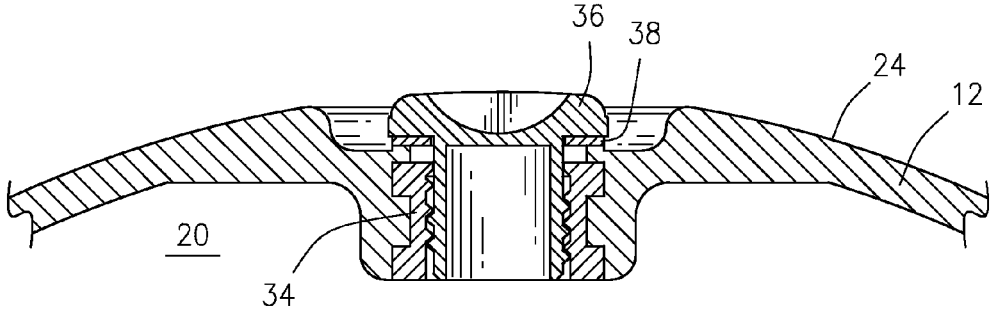
FIG. 8 is a cross-sectional view along line 8-8 of the exercise device shown in FIG. 7.

FIG. 8 in Between the Feet (Clockwise and Counterclockwise)

This motion will be primarily the same as the hand off, but the user will weave in and out of the legs making a FIG. 8. Rotate both clockwise and counterclockwise.

This exercise will work many of the same muscles as the hand off around the hips (exercise #24), but will lead to greater recruitment of the erector spinae and will place more direct focus on the quads, hamstrings, gastrocnemius and soleus. The element of instability the exercise device adds to the movement versus a kettlebell version will lead to greater core muscle fiber recruitment and neuromuscular development.

Example 26

Shouldering the Exercise Device

The user begins the exercise standing with feet shoulder width apart and toes pointed outward at a 30 degree angle, with the exercise device between the feet directly below the athlete. The knees should be slightly bent and the back should remain aligned throughout the entire range of motion. Reach down and grasp the exercise device without rounding the back, using the legs to lower the body. Engage the gluteus maximus and core to lift the exercise device to the shoulder, and then return the exercise device to the ground in one continuous movement. Repeat the motion, this time lifting the exercise device to the opposite shoulder.

The agonist muscles in the exercise are the hamstrings, quadriceps, spinal erectors, deltoids, lattisimus dorsi and biceps, while the synergist muscles are the gastrocnemius, soleus, serratus, oblique, the abdominals and the forearm muscles.

Example 27

Bent Presses

The user starts with the exercise device in one hand with the elbow against the body, and the exercise device resting on the outside of the forearm with the hand next to the anterior deltoids. The legs should be directly below the hips for optimal structure, and the toes should both be pointing 45 degrees away from the arm holding the exercise device. Begin to lower the body by pushing the hips out in the opposite direction of the arm holding the exercise device and allow the knees to bend while keeping the eyes on the exercise device to avoid torque on the cervical spine. The goal is to lock the arm holding the exercise device overhead by getting underneath the exercise device; there is no upward press in the range of motion. Once the arm is locked overhead, engage the gluteus maximus and core to return to an upright standing position, and then slowly lower the exercise device back to shoulder level to complete one repetition.

This movement essentially works every muscle in the body from the head to the toe, emphasizing explosive anaerobic strength and intramuscular coordination. The added benefit of the exercise device versus a kettlebell is the instability element, which will exponentially increase core muscle fiber recruitment.

Example 28

High Pulls

The user begins with feet shoulder width apart with toes pointed outward at a 45 degree angle. The exercise device should be about 6 inches behind the feet. Reach down to grasp the exercise device by pushing the hips back, keeping the spine aligned and the head up. Drive the hips forward explosively, causing the exercise device to arc in front of the body; at the top of the arc, engage the anterior deltoids and upper trapezius to pull the exercise device straight back, keeping the elbow high. Allow the exercise device to track back along the same arc, and, once it has completed the return path, explode with the hips once again to start the second repetition without any pauses throughout the range of motion.

This exercise will work the primary agonist muscles the quadriceps, hamstrings, gluteus maximus, anterior deltoids, posterior deltoids and biceps; while the synergist muscles will be the trapezius and core. The instability of the exercise device will allow for greater muscle fiber recruitment.

Level 2 Exercises

Example 1

Bent Press with Hand Behind the Back

Start with the exercise device in one hand with the elbow against the body, and the exercise device resting on the outside of the forearm with the hand next to the anterior deltoids. The legs should be directly below the hips for optimal structure, and the toes should both be pointing 45 degrees away from the arm holding the exercise device. The opposite hand is placed behind the back. Begin to lower the body by pushing the hips out in the opposite direction of the arm holding the exercise device and allow the knees to bend while keeping the eyes on the exercise device to avoid torque on the cervical spine. (Don't lock the arm overhead prior to beginning to lower the body?) The goal is to lock the arm holding the exercise device overhead by getting underneath the exercise device; there is no upward press in the range of motion. Once the arm is locked overhead, engage the gluteus maximus and core to return to an upright standing position, and then slowly lower the exercise device back to shoulder level to complete one repetition.

The agonist muscles are the internal obliques, deltoids, trapezius, erector spinae, gluteus maximus and abdominals, with the synergist muscles including the pectoralis minor, pectoralis major, quadriceps, hamstrings, gastrocnemius, soleus and triceps. This exercise builds anaerobic endurance as well as flexibility. Compared to a static weight, the use of the exercise device adds the unstable inertia effect that equals much higher muscle fiber recruitment.

Example 2

90 Degree Swing

The user keeps feet a foot wider than shoulder width apart. Bend at the knees in a squatting motion, holding the exercise device by a handle between the legs. Start the concentric phase of the squat and swing the exercise device vertically up until the arm is parallel with the ground. Once the arm is parallel, release the exercise device and allow it to rotate toward the user and catch it once it has rotated 90 degrees. Control the exercise device during the eccentric phase until back at the starting position.

This is a highly dynamic exercise that increases anaerobic endurance, and stabilization. The primary agonist and synergist muscle are the quadriceps, hamstrings, gluteus maximus, front deltoids and forearms. With the deceleration and sudden change of inertia produced during the eccentric phase of this exercise, there is more focus on the abdominals and spinal erectors to help stabilize the core than with a traditional kettlebell swing.

Example 3

180 Degree Swing

The user keeps feet a foot wider than shoulder width apart. Bend at the knees in a squatting motion, holding the exercise device by a handle between the legs. Start the concentric phase of the squat and swing the exercise device vertically up until the arm is parallel with the ground. Once the arm is parallel, release the exercise device and allow it to rotate toward the user and catch it once it has rotated 180 degrees. Control the exercise device during the eccentric phase until back at the starting position.

This is another very dynamic exercise with the primary agonist and synergist muscles being the quadriceps, hamstrings, gluteus maximus, front deltoids and forearms. With the deceleration and sudden change of inertia produced during the eccentric phase of this exercise, there is more focus on the abdominals and spinal erectors to help stabilize the core than with a traditional kettlebell swing.

Example 4

Lateral Step Swings

The user keeps feet a foot wider than shoulder width apart. Bend at the knees in a squatting motion, holding the exercise device by a handle between the legs. Grasp the exercise device with both hands on one handle. Start the concentric phase of the squat and swing the exercise device vertically up until the arm is parallel with the ground. As the exercise device arcs upward, take a lateral step so that the legs are 4 inches apart and immediately step out with the opposite leg so as the eccentric phase completes, the legs return to the starting position. Control the exercise device during the eccentric phase until back at the starting position.

This exercise increases balance and strength. The primary agonist and synergist muscles are the quadriceps, hamstrings, gluteus maximus, front deltoids, leg adductors and forearms. With the deceleration and sudden change of inertia produced during the eccentric phase of this exercise, there is more focus on the abdominals and spinal erectors to help stabilize the core than with a traditional kettlebell swing.

Example 5

Snatches

The user squats down with the spine aligned and lowers the exercise device between the knees with the arm straight and shoulder over the weight. Shrug the shoulders and pull the exercise device straight up while driving the hips forward. As the exercise device reaches shoulder level, drop into the bottom of a squat position; this will lock the exercise device in an overhead press position. Keep the arm straight and stand to a fully erect position. Lower the exercise device back between the knees and repeat. The snatch develops explosive strength as well as neurological coordination.

The agonist muscles are the trapezius, quadriceps, gastrocnemius, soleus and triceps, while the obliques, serratus, abdominals, spinal erectors, deltoids and pectoralis play the role of the synergists. Compared to a kettlebell, barbell or dumbbell snatch, the instability to the entire body added by the exercise device creates a proprioceptive element as well as requiring stabilization of the entire body at the end of the repetition.

Example 6

Split Snatches

The user squats down with the spine aligned and lowers the exercise device between the knees with the arm straight and shoulder over the weight. Shrug the shoulders and pull the exercise device straight up while driving the hips forward. As the exercise device reaches shoulder level, drop into the bottom of a lunge position; this will lock the exercise device in an overhead press position. Keep the arm straight and stand to a full erect position; bring the feet back to the starting position. Lower the exercise device back between the knees and repeat.

The split snatch develops explosive (plyometric) strength as well as neurological coordination. The agonist muscles are the trapizius, quadriceps, gastrocnemius, soleus and triceps, while the obliques, serratus, abdominals, spinal erectors, deltoids and pectorals play the role of the synergists. Compared to a standard snatch, there is a greater emphasis on all the muscles of the legs and a greater endurance element. Compared to a kettlebell, barbell or dumbbell snatch, the instability to the entire body added by the exercise device creates a proprioceptive element as well as requiring stabilization of the entire body at the end of the range of motion.

Example 7

Snatch With Throw

Squat down with spine aligned and lower the exercise device between knees with arm straight and shoulder over the weight. Shrug the shoulders and pull the exercise device straight up while driving the hips forward. As the exercise device reaches shoulder level, drop into the bottom of a squat position; release the exercise device at the end of the eccentric phase without any deceleration. Position over the exercise device to repeat the motion.

The snatch with throw develops explosive (plyometric) strength as well as neurological coordination. The agonist muscles are the trapizius, quadriceps, gastrocnemius, soleus and triceps, while the obliques, serratus, transverse abdominals, spinal erectors, deltoids and pectorals play the role of the synergists. When there is no deceleration at the end of the range of motion, more type II muscle fibers are recruited and the athlete can train to become more explosive. Snatching in this manner is virtually impossible with a kettlebell, barbell or dumbbell since the risk or injury and/or property damage is almost certain with an iron weight.

Example 8

Plyometric Jumps With Exercise Device Overhead

Grasp the exercise device with both hands and lock the arms in an overhead position. Maintain spinal alignment and lower the body by rocking the hips back, keeping the knees behind the toes. At the bottom of the squat, explode with the hips and knees, jumping as high as the user can into the air. To land safely, allow the knees to bend to absorb the shock of the landing.

Plyometric jumps train explosive strength and endurance. The agonist muscles are the gluteus maximus, soleus, gastrocnemius, quadriceps and hamstrings. The synergists are essentially all the muscles of the core. The use of the exercise device adds an increased engagement of the core as well as increases the proprioceptive awareness aspect of this exercise.

Example 9

Slashers

Hold the exercise device with both hands on one handle. Stand with feet a few inches past shoulder width apart and toes pointed outward. Start with the exercise device directly in front of one hip and use the legs and hips to drive the exercise device up to the opposite side shoulder. Allow the inertia of the exercise device to bring it all the way around the body and stop it in front of the opposite hip to the one that the exercise device was originally in front of. Reverse the momentum with the core and reverse the motion, going along the original path in the opposite direction.

Slashers utilize the abdominals, obliques, serratus, erector spinae, trapezius and posterior deltoid as the agonist muscles. The synergists are the quadriceps, hamstrings, biceps and triceps. The main focus of this exercise is stability and proprioceptive compensation ability. The exercise device recruits far more muscle fibers in the core due to the inertia of the exercise device during deceleration as opposed to the static resistance of a kettlebell.

Example 10

T Pushups

Begin in a pushup position with the exercise device directly under one shoulder. Maintain an aligned spine and tight core throughout the range of motion. Bring the chest down to the exercise device by bending the elbows, then immediately go back up by pressing yourself off the floor. At the top of the range of motion begin a pronated row; as the exercise device reaches the shoulder, press the exercise device up by rotating the hips and extending the arm. Bring the exercise device straight down to the ground.

The agonist muscles here are the trapizius, pectorals, the anterior deltoids and obliques, with the synergists being the posterior deltoids, serratus and biceps. The added compensation required to maintain stability adds a proprioceptive element as well as greater muscle fiber recruitment versus using a dumbbell or kettlebell.

Example 11

Walking Lunge with Overhead Presses

Start this movement with the upper body erect holding the exercise device parallel to the floor with a slight bend in the elbows. Step out far enough that the forward leg makes a 90 degree angle at the bottom of the eccentric phase of each repetition, making sure that the knees do not push out in front of the foot. Keep the weight in the heels and not in the toes. At the end of each eccentric phase, press the exercise device straight up until the elbows lock out, then lower it back down to chest level. After the user has finished the eccentric half of the repetition, step forward, bringing the feet back to a position where they are together. Alternate legs each repetition at press after each lunge.

This full body exercise utilizes the pectorals, deltoids, trapizius, core, triceps, hamstrings, gluteus maximus and quadriceps. The synergist muscles are the soleus, gastrocnemius, hip flexors and teres minor and major. The stability required to use the exercise device allows for greater muscle fiber recruitment.

Example 12

Squats with Exercise Device Locked Overhead

To properly execute this movement, the user will place feet at shoulder width, keeping knees and ankles aligned, as well as standing erect. Keep the chest high, shoulders back and keep the head up. Begin the squatting movement in the hips and not at the knees. Squat down like the user is sitting in a chair, keeping your back aligned and your upper body erect. The eccentric half of this exercise will end when the legs are at a 90 degree angle. Keep the body aligned and push through the heels, not toes, to finish the movement. The user will hold the exercise device directly overhead with one hand on each handle.

This exercise combines the dynamic use of the hamstrings, quadriceps and gluteus maximus as the agonists as well as the soleus, gastrocnemius and abdominals as the synergists. There is also an isometric contraction of the deltoids, pectoralis and triceps throughout the exercise. Using a exercise device will add resistance on all major planes of motion, adding much more core involvement.

Example 13

Clean/Jerk

The user begins the clean by squatting down to grasp the exercise device. Hands are positioned approximately a thumb's distance from hips. The lifter's arms are relaxed and just outside the legs with the exercise device up against the shins. The hips are as low as necessary to grasp the exercise device, with feet placed approximately at hip width. Weight is kept on the heels. The toes are angled out and the legs are directly under the hips. The chest is up and the spine stays aligned throughout the entire range of motion. This is the starting position of the "pull" phase of the lift. The lifter jumps the exercise device up through triple extension (in very quick succession) of the hips, knees and then ankles. When the legs have driven the exercise device as high as possible, the lifter pulls under the weight by explosively shrugging (contracting) the trapezius muscles of the upper back. This pulls the lifter under the exercise device and into a deep squat position. The lifter should stand (similar to a front squat) in preparation for the second phase. From the standing position, the lifter bends the knees and then straightens them in order to propel the weight upwards. The lifter pushes slightly with the arms. This pushes the lifter underneath the exercise device. One leg lunges forward while the other moves backward as the athlete drops into the bottom of the lunge. The lifter must hold the exercise device overhead, keep the arms locked, and move the legs directly underneath the torso so that the entire body lines up in a single plane.

The agonist muscles this exercise will target are the gluteus maximus, biceps, triceps, forearms, trapezius, lattisimus dorsi, hamstrings and deltoids, while the abdominals, teres major and minor, rhomboids and pectoralis muscles serve as the synergists muscles. Utilizing the exercise device will recruit more muscle fibers and increase the proprioceptive element of the exercise to a greater extent than with a kettlebell, dumbbell or barbell.

Example 14

Flys on Exercise Device

Begin in a supinated position on a stability ball, with feet flat on the ground and taking care not to let the lumbar spine arch. Hold an exercise device in each hand with the arms extended straight up. Allow the arms to extend downward until each arm is parallel to the floor on the lateral plane. Tighten the core and bring the arms back to the beginning of the motion, keeping the elbows slightly bent throughout the exercise.

The primary agonist and synergist muscles engaged in this exercise are the pectoralis major, pectoralis minor, anterior deltoids, and abdominals. The instability of the exercise device will greatly increase the recruitment of muscle fibers in the serratus and obliques versu a dumbbell or kettlebell.

Example 15

Getups

Start in a supinated position on the floor with an exercise device resting on one shoulder, using the same side hand to hold the exercise device in place throughout the exercise. Tuck the leg that is on the opposite side of the arm holding the exercise device underneath the other leg and use the arm to help the body sit up, at the end of the crunch get the legs underneath the body, stepping into a deep lunge position. Stand all the way up and bring the legs together, about shoulder width apart. Step back into a lunge with the same leg and reverse the entire range of motion until the lifter has returned to the supinated position.

This exercise is great for building core strength and stability. The agonists muscles are the abdominals, deltoids, gluteus maximus, hamstrings, and quadriceps; with the serratus, obliques, abdominals, soleus, gastrocnemius, and forearm muscles serving as the synergists. The exercise device builds greater proprioceptive awareness as well as increased muscle fiber recruitment compared to a sandbag, the traditional tool used for this exercise.

Example 16

Skydiver Holding Exercise Device Between Knees

Lay down in a prone position with the arms extended in front with palms down. Let the exercise device rest on top of the legs between the knees. Lift the arms and legs 6 inches up from the floor. Hold the isometric contraction for a set amount of time.

This isometric exercise will strengthen the erector spinae as well as engage muscle fibers in the lattisimus dorsi, rhomboids, teres major, teres minor and anterior deltoids while increasing proprioceptive awareness throughout the body.

Example 17

Lateral Swings with Catch (Alternating Hands)

Begin by standing with feet a few inches past shoulder width apart with toes pointing slightly outward. Holding the exercise device by the handle with one hand bend the knees and drive the hips a few inches forward; allow the power derived from the core and legs to transfer to the shoulders and use the energy to extend the arm laterally until the arm is parallel to the floor. Release the exercise device and bring the opposite hand across the body to catch the exercise device in an underhand grip; dip the knees and hips to once again drive the exercise device laterally, this time to the opposite side of the body and repeat the catch. A high number of repetitions not only conditions the muscles but the cardiovascular system as well.

The agonist muscles of this lateral swing are the medial deltoids and core, while the synergist muscles are the abductors, adductors and serratus. The use of a exercise device leads to greater muscle fiber recruitment of the core and less risk of injury versus an iron kettlebell.

Example 18

Back Extensions Holding Exercise Device on Scapula

Place feet in a back extension machine with the hips resting against the padding. Place the exercise device between the shoulder blades, holding the exercise device by each of the handles. Maintaining an erect cervical spine, descend down as far as possible without rounding the lumbar spine. Then reverse the motion and rise up until the torso is perpendicular to the ground.

The often neglected spinal erector muscles are the primary agonist muscles, with the gluteus maximus and hamstrings working as the synergist muscles. Holding an exercise device on the back will also recruit a much higher percentage of the core muscles throughout the exercise.

Example 19

Side Plank with Exercise Device Racked

The body is perpendicular to the ground, with only feet and forearm making contact with the floor. The exercise device is in the arm farthest from the ground, even with the deltoids and with the elbow resting against the body to distribute the weight throughout the core. The position is held isometrically for a set time.

The deltoids, gluteus maximus, obliques, pectorals and serratus muscles serve as the agonist during this isometric hold, while the abdominals and leg abductors act as the synergists. The stabilization required to use the exercise device will lead to greater balance and muscle fiber recruitment than a kettlebell or static weight.

Example 20

Circular Swings

The exercise starts with feet shoulder width apart, feet pointed slightly outward and knees bent. The exercise device is held even with the deltoids and the elbow resting against the torso. Rotate the upper body 45 degrees opposite the side holding the exercise device and extend the exercise device in the same direction; allow the exercise device to make a complete circle in front of the body back to the original starting position. Do for a number of repetitions, then switch hands and do the same number of repetitions on the opposite side.

This exercise engages the anterior deltoids, medial deltoids and obliques as the primary agonists, while the serratus, abdominals, quadriceps and hamstrings act as the synergists. A exercise device places a much greater emphasis on proprioceptive awareness and core muscle fiber recruitment than a kettlebell would in the same range of motion.

Example 21

Trunk Rotational Swings

Start with the feet directly under the hips and toes pointed straight ahead. Hold the exercise device by one handle with both hands. Extend the exercise device out directly in front of the user and pivot with the hips and turn on the exercise device to rotate 90 degrees the feet in one direction; use the core and hips to reverse the movement and rotate all the way to the opposite side of the body, creating a 180 degree range of motion.

This exercise is great for building trunk rotational strength and anaerobic endurance. The agonist muscles will be the obliques, serratus and abdominals. The synergist muscles are the hip flexors, quadriceps, leg adductors and leg abductors. Using the exercise device versus a medicine ball or kettlebell will increase stability and muscle fiber recruitment due to the sudden change of inertia.

Level 3 Exercises

Example 1

Hanging Knee Raises with Exercise Device

Hold the exercise device between the knees while suspended from a pull-up bar. Raise the knees straight up until the thighs are parallel with the floor. Lower the legs until the knees are straight and repeat for a number of repetitions.

This exercise is great for building core strength. The agonist muscles involved are the abdominals, hip flexors, leg adductors and forearms. The synergist muscles involved are the biceps, lattisimus dorsi, teres major, teres minor and spinal erectors. One of the main stressors in this exercise is to keep your body from swinging with or without using extra stimulus such as a medicine ball. The added resistance presented by the changing inertia of the exercise device greatly increases the amount of muscle fibers recruited during the exercise.

Example 2

6-12 Inch Leg Raises with Exercise Device

Lay supine on the ground. Place hands underneath lower back/gluteus maximus to fill the gap and avoid straining the back. Let the handles of the exercise device lay on top of the shins. Lift head slightly off the ground. Lift legs vertically one foot up and then back down 6 inches from the floor.

Repeat a set number of repetitions in this range of motion. This is another great exercise for building core strength. The agonist muscles used are the abdominals and hip flexors, with the synergist muscles being the quadriceps and the spinal erectors. The exercise device presents an unstable resistance increasing muscle fiber recruitment.

Example 3

Burpee With Exercise Device Slam

Start this exercise standing up holding both handles of the exercise device. Perform an exercise device Slam (exercise

#21 Level 1). Immediately afterwards, place palms face down and kick both feet back until the user is in the starting position to perform a pushup. Bring both feet back together and forward in a dynamic movement to where the knees are directly underneath the chest. Pick the exercise device up as the user stands up and repeat.

This exercise is great to increase anaerobic conditioning. The agonist muscles are the quadriceps, gluteus maximus, pectorals, lattisimus dorsi and biceps; the synergist muscles involved are the hamstrings, front deltoids, gastrocnemius, soleus, triceps and spinal erectors. Lifting, jumping and slamming the exercise device versus a medicine ball during this exercise adds the difficulty of controlling the inertia of the exercise device.

Example 4

Box Jumps Holding Exercise Device

Holding both handles of the exercise device, the user will perform a Kamagon plyometric squat jump (exercise #12 Level 1). Instead of jumping straight up vertically, the user will also project forward to land on a plyo box or bench.

This exercise will build explosive strength while increasing balance and anaerobic conditioning. The agonist muscles involved are the quadriceps, gluteus maximus, biceps, forearms, gastrocnemius and soleus. The synergist muscles being used are the hamstrings, front deltoids, abdominals and the spinal erectors. The benefit of the exercise device versus dumbbells or a medicine ball relates to controlling the unstable resistance which leads to greater core muscle recruitment.

Example 5

Bosu/Kamagon Squat Raises

Place a Bosu Ball with the blue side down and step onto the flat side. Hold both handles of the exercise device at arm's length in front of waist. Perform the eccentric phase of a squat while performing the concentric phase of an anterior raise at the same time. As the user performs the concentric phase of the squat, the user will perform the eccentric phase of the anterior raise until back to the starting position.

This exercise builds proprioceptive awareness, anaerobic endurance, balance and strength. The agonist muscles used are the quadriceps, gluteus maximus and hamstrings and front deltoids. The synergist muscles involved are the hamstrings, gastrocnemius, soleus, forearms, abdominals, spinal erectors and biceps. Traditionally, athletes have done squats and raises on a Bosu Ball with the added resistance of dumbbells or a medicine ball. The exercise device offers a second point of instability that greatly increases proprioceptive awareness, balance and core stability.

Example 6

180 Degree Trunk Rotations on Swiss Ball

Lay supine on a Swiss ball and hold both handles of the exercise device at arm's length. Keeping arms fully extended, rotate laterally 90 degrees to the right back to starting position and then 90 degrees to the left in one movement for a desired number of repetitions.

This exercise increases balance, proprioceptive awareness and trunk rotational strength. The agonist muscles involved are the obliques, serratus and abdominals. The synergist muscles involved are the forearms, deltoids and quadriceps. This exercise is traditionally done by athletes using a medicine ball. The constantly changing inertia of the exercise device results in the athlete developing greater balance, proprioceptive awareness and recruiting a higher number of muscle fibers.

Example 7

Step Up with 90 Degree Twist

Perform a Kamagon Step Up (exercise #11 Level 1). Holding the exercise device in front with both handles, rotate 90 degrees at the trunk in the direction of the leg that the user steps up with.

This exercise greatly increases balance, proprioceptive awareness, strength and anaerobic endurance. The agonist muscles involved are the quadriceps, gluteus maximus, obliques and serratus. The synergist muscles involved are the hamstrings, abdominals, biceps and deltoids.

Example 8

Frog Jumps with Slam

Holding the exercise device by both handles, the user will perform a plyometric squat jump similar to exercise #12, except the user will not only jump as high as the user can vertically, but forward as well. Land and repeat for a desired number of repetitions.

This exercise increases anaerobic endurance and explosive strength. The agonist muscles are the quadriceps, gluteus maximus, hamstrings, gastrocnemius, soleus, deltoids and triceps. The synergist muscles are the abdominals, biceps, serratus and lattisimus dorsi. The explosive nature of this exercise combined with the changing inertia of the exercise device recruits far more muscle fiber than when done with a traditional medicine ball.

Example 9

Plyometric Split Jumps with 90 Degree Twist

Start this exercise with one leg forward in the bottom position of a lunge. Hold the exercise device by both handles with the elbows at the sides and the exercise device in front of the chest. Jump high enough to switch legs in mid-air, landing with the opposite leg forward in the bottom of a lunge position. Land the jump with the majority of your weight on the foot in front of the user. Rotate at the trunk 90 degrees and back in the direction of the forward leg every time the user lands.

This exercise increases anaerobic endurance, proprioceptive awareness and explosive strength. The agonist muscles involved are the quadriceps, gluteus maximus, hamstrings, obliques, serratus, gastrocnemius and soleus. The synergist muscles are the biceps, deltoids, abdominals and spinal erectors. This explosive movement, combined with the unstable inertia of the exercise device greatly improves balance and proprioceptive awareness compared to a medicine ball.

Example 10

Side Plank Extensions

The body is perpendicular to the ground, with only the feet and forearm making contact with the floor. The exercise device is in the arm farthest from the ground. Let the exercise device rest at the waist. Extend the exercise device to a full arm's length and back down for a desired number of repetitions and then switch sides.

This purpose of this exercise is to focus on balance, stability and proprioceptive awareness. The agonist muscles involved are the obliques, abdominals, serratus, deltoids and spinal erectors. The synergist muscles are the triceps, teres minor, teres major and the leg abductors. The benefit of the exercise device versus a dumbbell or static weight is the increase in muscle fiber recruitment due to the added difficulty of balancing the exercise device's inertia throughout the movement.

Example 11

Kamagon Pistols

Balance on one leg holding the exercise device by both handles in front of the user. Extend the other leg in frontr. Perform a squat using only the leg the user is balancing on.

This exercise requires extreme balance and stability. The agonist muscles are the quadriceps, hamstrings and gluteus maximus. The synergist muscles are the, deltoids, abdominals and spinal erectors. The balance required to execute this movement increases proprioceptive awareness far more than using a static weight.

Example 12

Turkish Getup with Exercise Device

Lay supine on the ground holding the exercise device by the handle with one arm extended directly above. Lift the back off the floor as if the user were performing a crunch. With the arm not holding the exercise device, brace with the elbow and fist, and then straighten that arm until it's fully extended, placing your weight against the palm. On the same side of the body as the arm the weight is on, bend the knee and bring the foot back. Stand up, bringing both feet together. Make sure the arm holding the exercise device stays fully extended and directly above the user throughout the movement. Reverse the steps to lower yourself back down to the starting position.

This exercise focuses on core stability and strength. The agonist muscles involved are the abdominals, quadriceps and gluteus maximus. The synergist muscles involved are the hamstrings, obliques, deltoids and triceps. This exercise is very popular among athletes and most commonly executed with a kettlebell. The benefit of the exercise device is the added balance and stability gained through controlling the inertia of the exercise device.

Example 13

Kamagon Overhead Lunges with Trunk Rotation

Hold the exercise device by both handles above head. Perform a lunge and rotate at the trunk 90 degrees at the bottom of each step in the direction of the forward leg. Alternate legs each step.

This advanced exercise requires multiple components such as balance, stability, proprioceptive awareness and anaerobic endurance. The agonist muscles involved are the quadriceps, gluteus maximus, hamstrings and obliques. The synergist muscles involved are the abdominals, gastrocnemius, soleus, serratus, spinal erectors, triceps and deltoids. The exercise device recruits a higher number of muscle fibers than a medicine ball or static weight due to the fact The user must stabilize the inertia of the exercise device.

Example 14

Trunk Rotations from Pistol

In this exercise the user will perform a pistol (exercise #11 Level 3). At the bottom of the squat, rotate 90 degrees at the waist in the direction of the leg the user is balancing on. This exercise will develop balance, proprioceptive awareness and strengthen trunk rotation.

The agonist muscles involved are the quadriceps, gluteus maximus, obliques and serratus. The synergist muscles are the abdominals, deltoids, biceps and hamstrings. The benefit of the exercise device versus a medicine ball is the stabilization required to balance the inertia of the fluid.

Example 15

Bosu Lunges with Exercise Device

Place a Bosu Ball with the flat side on the ground, blue side up. Center the arch of the foot in the middle of the exercise device. Place the other foot behind the user on a bench or plyo box at a distance that will allow a 90 degree angle in the forward leg as the user lowers down into a lunge position. Hold the exercise device by both handles in front. Keep the weight in the forward leg on the heel, and keep from pushing with the toes to keep pressure off the knee. Use the leg behind the user for balance only. Lower down into a lunge for a desired number of repetitions and then switch legs.

The main objectives in this exercise are to increase balance, strength and proprioceptive awareness. The agonist muscles are the quadriceps, gluteus maximus and hamstrings. The synergist muscles are the biceps, deltoids, gastrocnemius, soleus, abdominals and spinal erectors. Having two points of instability greatly increases proprioceptive awareness and balance.

Example 16

Bosu/Exercise Device Lunges with Trunk Rotation

The user will perform a lunge using the Bosu Ball and exercise device together exactly like exercise #15 above, except that the user will rotate 90 degrees in the direction of the forward leg at the bottom of the lunge.

This exercise has the same benefits as the standard Bosu/Kamagon Lunge with the added benefit of trunk rotational strength. The additional muscles engaged are the oblique and senate.

Example 17

Lateral Plyometrics Jumps with Exercise Device

Start with feet one foot wider than shoulder width apart with toes pointed outward at 45 degrees. Squat down by shifting the hips back and bending the knees, taking care to keep the knees behind the toe line. Explode by driving the hips forward and straightening the legs, using the momentum to jump laterally as far as possible. Make sure to go both directions an equal number of times.

This exercise develops explosive power, anaerobic conditioning and balance. The primary agonist muscles are the quadriceps, hamstrings and gluteus maximus. The synergist muscles involved are the leg adductors, biceps, deltoids and abdominals. The instable inertia of the exercise device increases balance and muscle fiber recruitment.

Example 18

Exercise Device Extended Arm Sit-Ups

Start in a supinated position with the legs extended upward at 45 degrees. Hold the exercise device by both handles with the arms fully extended. Perform a sit-up and touch the exercise device to the toes; return to the starting position while maintaining tension in the core to control the descent.

The primary focus of this exercise is to increase core strength. The agonist muscles involved are the abdominals, while the synergist muscles are the serratus, deltoids and spinal erectors. Due to its unstable resistance, the exercise device's effectiveness far exceeds those of the medicine ball or static weight in muscle fiber recruitment, proprioceptive awareness and stability.

Example 19

180 Degree Plyometric Jumps (Alternating)

This exercise will be done just like the Lateral Plyometric Jumps (#17 above), but instead of using the momentum of the jump to propel the body laterally, it will be used to rotate the entire body 180 degrees while alternating the direction.

This exercise builds anaerobic endurance, explosive power, balance, stability and proprioceptive awareness. The agonist muscles are the quadriceps, gluteus maximus, obliques, hamstrings, gastrocnemius and soleus. The synergist muscles are the leg abductors, leg adductors, biceps, abdominals, serratus and spinal erectors. The added factor of controlling the inertia in the exercise device while changing directions recruits far more muscle fibers throughout the body.

Example 20

Back Extensions with Anterior Raise

Place the feet in a back extension machine with the hips resting against the padding. Reach down and grasp the exercise device by each handle. Maintaining an erect cervical spine, descend as far as possible without rounding the lumbar spine. Then reverse the motion and rise until the torso is perpendicular to the ground, while simultaneously performing an anterior deltoid raise with the exercise device (exercise #13 Level 1).

This exercise builds strength while improving stability. The agonist muscles used are the spinal erectors, gluteus maximus and anterior deltoids. The synergist muscles are the trapezius, rhomboids and hamstrings. The changing inertia of the exercise device recruits a greater number of muscle fibers and increases proprioceptive awareness.

Example 21

Overhead Press (without Using Handles)

Rest the elbow of the working arm against the torso with the hand parallel to the deltoid. Use the opposite hand to place the bottom of the exercise device in the flat of the palm, balancing the weight in the hand. Maintaining balance, extend the arm straight overhead; after locking the elbow, slowly reverse the motion until the arm is once again resting in the starting position and repeat.

This movement will build strength primarily in the agonist muscles: the deltoids, triceps and core, as well as the synergistic muscles of the pectoralis major. The inertia of the exercise device will add a proprioceptive element not found with a traditional kettlebell overhead press. Taking the handles out of the equation exponentially increases the stability aspect of the exercise.

Whereas, the systems and methods have been described in relation to the drawings and claims, it should be understood that other and further modifications, apart from those shown or suggested herein, may be made within the spirit and scope of this invention.

What is claimed is:

1. An exercise device, comprising:

an outer membrane forming a generally spherical, watertight interior compartment capable of being filled with a sufficient volume of a destabilizing liquid to impose a workload on a user's body during exercise, said outer membrane being constructed of a moldable, non-rupturable, thermoplastic polymer material having a sufficient durometer, tensile strength and density to allow said exercise device to be used in dynamic exercises when filled with said destabilizing liquid without tearing, bursting, rupturing or leaking, said outer membrane constructed having no internal bladder, baffles or other means to stabilize or impede movement of said destabilizing liquid within said interior compartment, resulting in a predictable direction of flow of said destabilizing liquid, allowing said user to adjust for an anticipated direction of flow of said destabilizing liquid during said exercise with said exercise device;

a handle integrated with an exterior surface of said outer membrane;

a knob integrated with said exterior surface of said outer membrane;

two shoulder straps secured to said exterior surface of said outer membrane in spaced apart relationship so that each strap forms a loop for receiving the arm of said user, each shoulder strap secured to a separate horizontal chest strap via one end of said horizontal chest strap, and an opposite free end of each of said chest straps provided with a hook and loop fastener; and an inlet port in fluid communication with said interior compartment formed by said outer membrane;

wherein the destabilizing liquid provides weight resistance to muscular movement in order to build muscle and provides destabilization of said exercise device as an aid in improving said user's balance and coordination by working said user's stabilizing muscles.

2. The exercise device of claim 1 wherein said outer membrane, said handle and said knob form a unitary, contiguous exercise device.

3. The exercise device of claim 1 wherein said outer membrane is transparent or translucent through which said volume of said destabilizing liquid contained within said interior compartment of said exercise device can be discerned.

4. The exercise device of claim 1 wherein said outer membrane has a density range of approximately 0.040 to approximately 0.050 lbs./cubic inch, with a minimum tensile yield strength of approximately 2500 lbs./square inch minimum and a durometer range of approximately 40 to approximately 90 Shore A.

5. The exercise device of claim 4 wherein said density range of said outer membrane is approximately 0.42 to approximately 0.43 lbs./cubic inch and a durometer range of approximately 50 to approximately 60 Shore A.

6. The exercise device of claim 1 wherein said outer membrane is fairly rigid and not stretchable, flexible or collapsible to a significant degree.

7. The exercise device of claim 1 wherein said interior compartment formed by said outer membrane has a fluid capacity of approximately 5.57 gallons.

8. The exercise device of claim 2 wherein said exterior surface of said outer membrane, said handle and/or said knob are textured to provide for increased grip.

9. The exercise device of claim 1 wherein said exterior surface of said outer membrane has horizontal marking lines to indicate the weight of said exercise device with differing volumes of said destabilizing liquid.

10. The exercise device of claim 1 wherein said handle is constructed of a textured, moldable, polymer material having a density and durometer similar to that of said outer membrane.

11. The exercise device of claim 1 wherein said handle and said knob are attached at diametrically opposite points on said exterior surface of said outer membrane.

12. The exercise device of claim 1 wherein said handle is a plurality of handles.

13. The exercise device of claim 12 wherein said plurality of handles are integrated to said exterior surface of said outer membrane at approximately 90 and approximately 180 degree orientations relative to each other.

14. The exercise device of claim 12 wherein said plurality of handles are two handles integrated in diametric opposition to each other on the sides of said exterior surface of said outer membrane.

15. The exercise device of claim 12 wherein said plurality of handles further comprises a first handle and a second handle attached at antipodal points on said exterior surface of said outer membrane and a third handle attached along a great circle arc between said antipodal points on said exterior surface of said outer membrane.

16. The exercise device of claim 2 wherein said knob is mushroom-shaped having a stem portion that widens to a dome portion.

17. The exercise device of claim 16 wherein said dome portion of said knob is sized to allow the palm of said user's hand to cover said knob while allowing just the fingers of said user's hand to curl under said dome portion during grip strengthening exercises resulting in less ergonomic grip, forcing said user to directly engage the smaller muscle groups of the flexor carpi radialis, flexor carpi ulnaris and/or brachioradialis of the forearms and hands.

18. The exercise device of claim 16 wherein said stem portion of said knob elevates said dome portion away from said exterior surface of said outer membrane a distance sufficient to allow the fingers of said user's hand to curl under said dome.

19. The exercise device of claim 16 wherein said knob is constructed of a textured, moldable, polymer material having a density and durometer similar to that of said outer membrane.

20. The exercise device of claim 16 wherein said knob is a plurality of knobs.

21. The exercise device of claim 20 wherein said plurality of knobs are integrated with said exterior surface of said outer membrane at approximately 90 and approximately 180 degree orientations relative to each other.

22. The exercise device of claim 20 wherein said plurality of knobs further comprises a first protruding knob and a second protruding knob attached at antipodal points on said exterior surface of said outer membrane and a third protruding knob along a great circle arc between said antipodal points on said exterior surface of said outer membrane.

23. The exercise device of claim 1 wherein said inlet port is an air valve in fluid communication with said interior compartment for insertion or removal of an amount of air into said interior compartment in order to eliminate any minor dimpling of said outer membrane.

24. The exercise device of claim 1 wherein said inlet port is a water port in fluid communication with said interior compartment to fill or empty said interior compartment with said destabilizing liquid.

25. The exercise device of claim 24 wherein said water port is recessed into said exterior surface of said outer membrane and further comprises a rounded edge in order to eliminate any cutting or discomfort from said edge when closing said water port or during exercise with said exercise device.

26. The exercise device of claim 24 wherein said water port further comprises a receptacle having internal tapered screw threads, a plug having external treads similar to said screw threads of said receptacle, and a gasket capable of being placed intermediate of the mating surfaces of said receptacle and said plug to form a seal to prevent leakage of said destabilizing liquid from said interior compartment.

27. The exercise device of claim 1 wherein said destabilizing liquid is water.

28. The exercise device of claim 1 wherein said outer membrane further comprises a flattened side, one end of each of two pieces of a strap secured to opposed edges of said flattened side and opposite free ends of said two pieces of said strap provided with hook and loop fasteners to allow said strap to secure said exercise device to said user's limbs.

29. The exercise device of claim 28 wherein said flattened side and/or said strap is padded.

30. The exercise device of claim 1 wherein each of said shoulder straps comprises two pieces that are connected by an adjustment mechanism for adjusting the length of said shoulder strap.

* * * * *